US006648715B2

(12) United States Patent
Wiens et al.

(10) Patent No.: US 6,648,715 B2
(45) Date of Patent: Nov. 18, 2003

(54) SNAP-FIT CONSTRUCTION SYSTEM

(76) Inventors: Benjamin I. Wiens, 8-1200 Brunette Ave., Coquitlam, BC (CA), V3K 1G3; Eric G. McIntosh, 207-1066 E 8th Ave., Vancouver, BC (CA), V5T 1T9

( * ) Notice: Subject to any disclaimer, the term of this patent is extended or adjusted under 35 U.S.C. 154(b) by 0 days.

(21) Appl. No.: 10/117,847

(22) Filed: Apr. 9, 2002

(65) Prior Publication Data

US 2003/0082986 A1 May 1, 2003

(51) Int. Cl.[7] ..... A63H 33/08
(52) U.S. Cl. ..... 446/121; 446/124
(58) Field of Search ..... 446/85, 108, 116, 446/120, 121, 124, 127, 128

(56) References Cited

U.S. PATENT DOCUMENTS

| | | | | |
|---|---|---|---|---|
| 2,619,829 A | | 12/1952 | Tatum | |
| 2,885,822 A | | 5/1959 | Onanian | |
| 3,005,282 A | | 7/1961 | Christiansen | |
| 3,815,311 A | | 6/1974 | Nisula | |
| 4,126,978 A | | 11/1978 | Heller | |
| 4,253,268 A | | 3/1981 | Mayr | |
| 5,061,219 A | | 10/1991 | Glickman | |
| 5,137,485 A | * | 8/1992 | Penner | 446/111 |
| 5,267,863 A | | 12/1993 | Simmons | |
| 5,518,434 A | | 5/1996 | Ziegler | |
| 5,645,464 A | * | 7/1997 | Chen | 446/120 |
| 5,704,186 A | | 1/1998 | Alcalay | |
| 5,853,314 A | | 12/1998 | Bora | |
| 5,957,744 A | | 9/1999 | Mott | |
| 5,970,673 A | | 10/1999 | Fisher | |
| 5,984,756 A | | 11/1999 | Krog | |
| 6,050,044 A | | 4/2000 | McIntosh | |
| 6,447,360 B1 | * | 9/2002 | Sorensen | 446/124 |

FOREIGN PATENT DOCUMENTS

GB 2224953 A 5/1990

* cited by examiner

*Primary Examiner*—Jacob K Ackun

(57) ABSTRACT

A modular construction system featuring an improved snap-fit connection element that can be incorporated into a wide variety of construction elements. These construction elements may be made in a range of sizes and used in a variety of fields such as, construction, toys, educational, machinery, products, jigs, two and three dimensional art, and signs. Various shapes disclosed are blocks, beams, radial-hubs, struts, rods, wires, panels, plates, rotators, adaptors, and locks. The preferred connection element comprises of a bendable pair of male ribs containing ridges that snap-fit into a pair of grooves of a mating female connection element. The grooves contain projections at roughly their midpoint and locate into mating indentations in the ridges. This connection element is more exotic than typically used, but can be snap-fit together or taken apart easily in a variety of directions while still allowing it to be molded inexpensively.

20 Claims, 27 Drawing Sheets

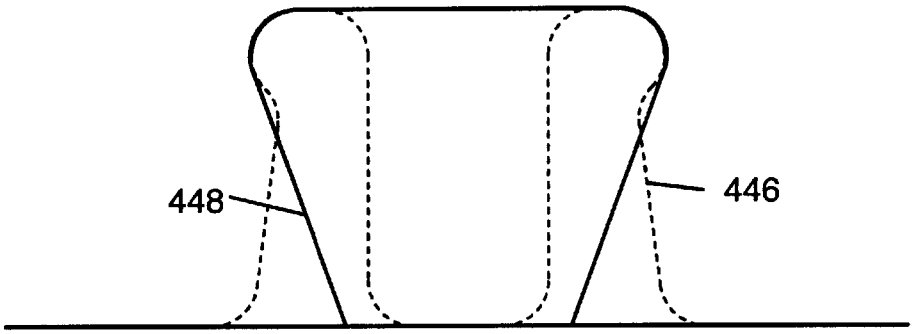
Fig. 69
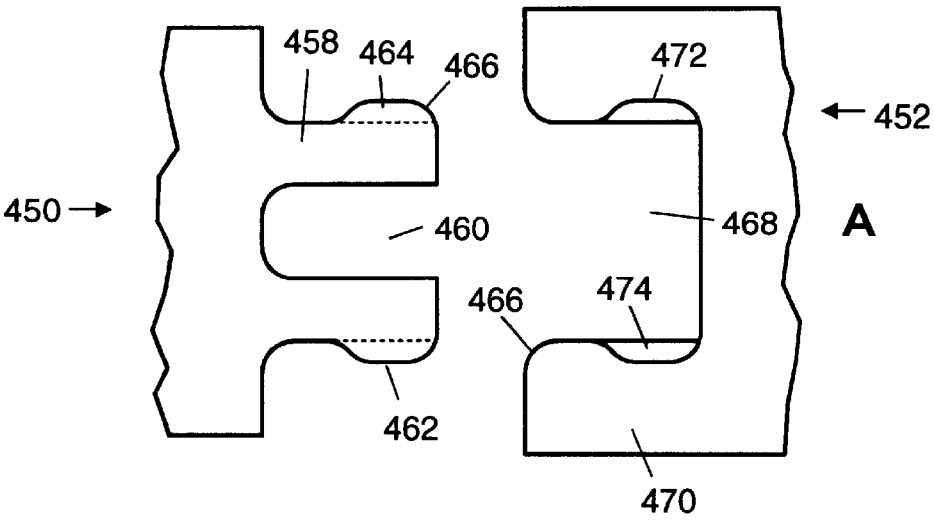
Fig. 70
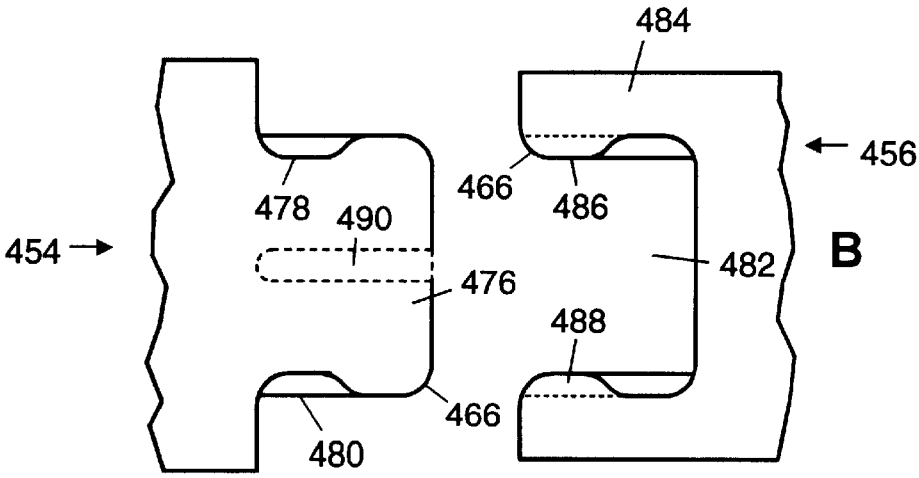

SNAP-FIT CONSTRUCTION SYSTEM

BACKGROUND

1. Field

The invention relates to modular construction systems that have releasable snap-fit connection elements that are actually interlocking features of the construction elements themselves, which can be integrated into many differently shaped construction elements and be useful in a variety of fields.

2. Prior Art

Construction systems incorporating various methods of connecting construction elements together are known in the art. Many construction elements connect primarily on one or two faces. One construction toy that connects on two faces is the brand "Lego Classic," shown in U.S. Pat. No. 3,005,282. A stud and friction-fit type of connection is used on what are generally considered to be the top and bottom faces of a construction block. This type of connection system is deficient however, as these blocks may not be connected on the other faces, such as side-to-side in a single layer in order to create a span, or overhang, or to construct a beam projecting outwards. Such blocks can be inexpensively produced with simple plastic injection molds. The same studs could be added to more faces, however this would result in more expensive production.

Construction elements with connection elements on more than two faces have been developed. The most common form seen in toys is of the brand "Lego Technic," which uses studs and cavities on the top and bottom faces, and through-holes projecting through two of the remaining faces of block and beam construction elements. Snap-fit pins pushed through the holes can be used to connect two or more construction elements together. Such construction elements require more expensive molds to produce than the "Lego Classic" type because the draw in the mold is in more than one direction. Using holes rather than extra studs and cavities results in more flexibility in construction. Engaging many construction elements together side-to-side with snap-fit pins is not considered very practical however.

Another method of engaging construction elements together that is less common in toys but more popular in larger construction systems is the dovetail connection. For example, U.S. Pat. No. 2,619,829 by "Tatum" shows a hollow construction block, suitable for blocks made of concrete, which contains one fixed male, and one or more female dovetails in the side of the block. A separate double male connecter is also provided to connect two opposing female dovetails when required. Such a system can connect blocks together on all sides. As well, both the male as well as female dovetails extend only halfway down the block's sides. This results in a bottom ledge in the female dovetail and prevents the captive male dovetail from sliding through. Of course there is nothing to prevent the male dovetail from sliding back out again. The block faces having dovetails can be secured in only five of six spatial directions. When such blocks are used in multi-layer constructions such as walls, most of the half-height male and female dovetails become captive between adjacent blocks. This reduces the problem of connections coming apart somewhat. There is a problem however in using this system to construct single layer longitudinal objects such as floors or beams.

A similar half-height dovetail connection method is used on toy blocks of the brand name "Kitslink," which is shown in U.S. Pat. No. 6,050,044. In this system however, a stud and cavity friction-fit type of connection is used to connect blocks on the top and bottom faces as well. This design allows construction elements to be engaged to each other on all six faces, but still the dovetail sides can be secured in only five of six spatial directions. This is more of a problem with toys where more complex structures are constructed as opposed to constructing walls in the previously mentioned construction system. One way of keeping the dovetails from sliding apart would be to use a friction fit, but this would make the blocks quite hard to put together and especially to take apart. A real disadvantage of this system when used for toys is that the blocks cannot be pushed together in the longitudinal direction of the faces that contain the dovetails. Instead, the block with the male dovetail must be lowered vertically into the female dovetail. As well, when dismantling the structures, the dovetails must be withdrawn in the opposite direction of the assembly. The right direction of disassembly is not clear when viewing the built structures. When single layer, long beamlike objects are assembled, the half-height dovetails can be subjected to tremendous stress if they are handled roughly during play. It is not very difficult to tear apart the dovetails, in which case the blocks become permanently damaged.

Yet another toy block with brand name "Morphun" is shown in U.S. Pat. No. 5,957,744. This block uses full-length female dovetail or star shaped grooves in the block sides. To connect the blocks together, they are placed side-by-side and a star shaped connecter is inserted into the facing grooves. This design also does not require studs or other connecting means on the top and bottom faces because the star shaped connecters can be taller than the blocks and so can join blocks both vertically as well as longitudinally. The star shaped connecter is slightly flexible and is designed to have a reasonable friction-fit or a mild compression lock. This makes the structures much more secure than with the previous dovetail design, and blocks can be secured on six faces in six spatial directions. However the blocks still cannot be pushed together longitudinally on the dovetailed sides and must be carefully slid apart from the star shaped connecters to avoid being damaged. The star shaped connecters are generally small and so could cause choking in children if they are swallowed.

While both the "Kitslink" and "Morphun" designs result in much more elaborate constructions than can be created using the standard "Lego Classic" construction blocks that locate on only two faces, both have two inherent problems. Construction using these blocks must be done in layers, as the blocks cannot be engaged longitudinally or inserted in the middle of structures. As well, the blocks are meant to be disassembled by carefully sliding apart the blocks or connection elements, and rough disassembly can result in severe damage to the connection elements on the blocks.

The solution to the problem of careful assembly and disassembly has often been to use a type of snap-fit connection. In U.S. Pat. No. 2,885,822 by "Onanian," a block and beam construction system using split hollow blocks with holes in every face is shown. A round double male snap-fit connection element with a pair of outward facing ribs is used to connect blocks together. Such structures can be snap-fit together or apart and can be secured on six faces in six spatial directions. While this design solves the problems of damage to blocks through rough disassembly, the blocks can only be inserted directly towards the face. This design is therefore deficient in that it does not allow for blocks to slid into a space. As well, the production of hollow two part blocks is expensive and the small separate male connection elements are difficult to remove and could also be a choking hazard for children.

A popular snap-fit strut type of construction system with brand name "K'nex" is show in U.S. Pat. No. 5,061,219. In this case, male rods are snap-fit sideways into female fittings, but now engaging or separating along the length of the rods is not possible. It is true that the connections don't need to be carefully slid apart, but separation by a bending action can result in high point contact loads that may result in some damage to parts. A somewhat similar rod type construction system is also shown in U.S. Pat. No. 5,704,186 by "Alcalay".

Another design shown in U.S. Pat. No. 5,518,434 by "Ziegler" shows a toy construction system using beams having a pair of rounded flexible male fingers which snap-fit into a female square recess. Beams are snap-fit together end to end but not side to side. The rounded snap-fit fingers allow twisting the connection. This could be an advantage or a disadvantage depending on the models being built.

A more versatile snap-fit design with brand name "Lego Znap" is shown in U.S. Pat. No. 5,984,756. In this beam construction system, a pair of flexible female fingers snap-fit onto a squared male plug. Connections can be separated sideways or longitudinally with no damage to the parts.

Various other snap-fit construction elements have been suggested as well. For example, U.S. Pat. No. 4,126,978 by "Heller" shows an extruded construction channel using a pair of male ribs which snap-fit into a female recess with grooves. U.S. Pat. No. 3,815,311 by "Nisula" shows another extruded construction module which contains male ribs which snap-fit into separate female recesses. A construction block, shown in U.S. Pat. No. 5,970,673 by "Fisher" shows paired male fingers which snap-fit into female slots. Another toy, shown in U.S. Pat. No. 4,253,268 by "Mayr" shows a pair of male curved ribs which slide around an open ended female recess containing a central post.

Snap-fit connections, especially for toys, are desirable because they can result in secure side connections, they prevent damage to parts on disassembly, and they are fast to assemble and disassemble. The disadvantage of open sided snap-fit systems such as the extruded channels by "Heller" is that there is no provision for preventing the joined elements from sliding in the direction of the grooves. They are meant for construction systems where a natural ledge such as a floor prevents movement. Designs such as "Znap," "Ziegler," and "K'nex," use projections at the ends of the two open sides of the female recess. On "Znap" and "Ziegler" designs, only one ledge is used per female recess side. This still locks the connection together in six of six possible spatial directions but is much easier to mold than if paired ledges were used on each female recess side. The disadvantage of such ledges on the ends of the female open sides is that it is difficult to assemble construction elements because the flexible snap-fit members must be bent rapidly at the very start of the connection as there is not enough distance available generally for a gradual compression.

Objects and Advantages

The invention is a new modular construction system that incorporates a novel snap-fit type of connection system that overcomes many of the previously mentioned problems of construction systems. The objects and advantages of the invention are:

(a) that construction elements can be easily molded with simple molds which have a draw in a single direction or by other inexpensive production methods. No system has been suggested previously that has so many advantages and features as the invention and yet can be so easily produced.

(b) to provide a connection system that is suitable to be used both for construction blocks as well as a wide variety of other construction elements. No system has been suggested previously that can be built in so many different configurations as the invention.

(c) to provide a connection system that allows construction elements to be engaged or separated by either pushing toward each other or apart, or sliding together or apart. It appears that only the prior art "Znap" system can be assembled and disassembled in so many directions, but this system is not practical for block construction elements, and is harder to assemble than the invention.

(d) to provide a snap-fit connection element that can secure construction elements in six of six possible spatial directions. Several prior art systems mentioned can do this, however they can not be used in as many configurations or have the same ease of use as the invention.

(e) to provide a construction element that is not required to be made of multiple pieces. Some prior art such as "Tatum" use hollow blocks made of two pieces to achieve some of the advantages claimed in the invention.

(f) to provide a construction system where the connection elements can be molded integral with the construction element. Some prior art toy systems such as "Morphun" require separate connection elements to be used for engaging construction elements together to achieve the claimed advantages over prior art, but this could be a choking hazard for children. Most embodiments of the invention do not require separate connection element pieces to be used.

(g) to provide a construction system where the connection elements have little play when construction elements are put together yet allows the construction elements to be put together and taken apart with little effort. Other prior art such as "Kitslink" with its rigid dovetail connection system requires a small amount of clearance between parts for easy assembly. In the invention, the flexible snap-fit elements remove this play.

(h) to provide a connection system where both integral and separate connection elements can be used. Very few prior art designs can use both. The invention allows more complex construction systems to be made by being able to use both systems.

(i) to provide a construction system where extremely close manufacturing tolerances are not required. Some other snap-fit construction elements with nearly right-angle connection contact angles require extremely tight manufacturing tolerances. In the invention, less than right-angle connection contact angles are preferably used where the connection play can be removed entirely even with normal manufacturing tolerances.

(j) to provide a construction system where two construction elements can be slid together easily during the beginning of the connecting process, which requires less dexterity in construction. In other designs such as "K'nex" and "Znap," it is often hard to feel where the connection elements will go together. For example, in the "Znap" design, when inserting the male connection element into the female connection element vertically, the flexible walls must be bent apart quickly at the very start of the connection. In the invention, with this type of sliding together of connection elements, the male ribs can be inserted almost half way down the female recess till encountering some projections. This makes it much easier to start assembling the two construction elements before applying more pressure to ride over these projections.

(k) to provide a connection system where it is hard to damage the connection elements during rough engagement or separation. In other designs such as "Kitslink," the dovetail connection elements can be easily damaged. In the invention, the snap-fit connection method reduces the possible damage substantially by being designed to separate in many different directions.

(l) to provide a construction system that can be used with other popular construction systems. The various different configurations of the invention can be built to allow mating with a larger variety of other construction systems, and allow more adaptors to be built.

(m) to provide a construction system that can be made of inexpensive materials. Some prior art snap-fit systems such as "K'nex" and "Znap" are largely made of expensive Acetal plastic resin. The invention allows cheaper plastics such as Polypropylene to be used in many of the configurations.

(n) to make the construction elements look good. Some other prior art such as "Znap" do not fit together with the same clean lines due to the design of the snap-fit connection elements. Most embodiments of the invention result in two interlocking connection elements where only a simple rectangular space remains. As well, parts of the connection elements can be molded flush with the top and bottom surfaces of the construction element giving a clean, flush appearance. The full height connection element features of the invention especially look good when many block construction elements are stacked vertically. The continuous male ribs and female anti-twist bars on such walls and columns give them a rich Gothic ribbed appearance.

(o) that construction elements can be engaged on all sides. Some prior art such as "Lego Technic" cannot be engaged together on all sides even though this design requires more expensive molds. In the invention all sides can be engaged while still being able to be produced with inexpensive molds.

(p) that construction element can be non-handed. In some prior art such as "Kitslink" there is either a male or a female dovetail connection element on sides using dovetail connection elements. This requires turning each block to the proper orientation when assembling. In the preferred embodiment of the invention, a male and a female connection element are paired, which makes the connection non-handed.

(q) that construction elements can be engaged inverted. In some prior art such as "Kitslink" or "Tatum," upright construction elements cannot generally be engaged to inverted ones. They can be if in a vertically staggered position only. In the invention, many types of upright construction elements can be engaged to inverted ones, though in the preferred embodiment the blocks must be staggered horizontally to do so.

(r) that construction elements can be engaged staggered vertically. In some prior art designs such as "Onanian," each face of the construction elements must match. In the invention, construction elements can be securely engaged half-way vertically between two other construction elements.

(s) that the connection elements fit between the confines of a stud and cavity construction system. In some prior art such as "Kitslink," the dovetail connection elements protrude too far beyond the side surfaces of the construction element and so must be placed between a pair of studs on construction blocks. In the invention, the connection elements are located partly inside and partly on the outside of the side surfaces, which allows the connection elements to be placed directly between two studs.

(t) that the connection protrudes minimally outside the construction element. Again, on prior art such as "Kitslink," the connection elements protrude substantially beyond the sides of the construction elements. In the invention, the connection element is located partly inside and partly on the outside of the side surfaces, which reduces the distance the connection elements project to the outside of the construction element.

(u) to provide a construction system where a construction element will sit level when placed on its side. On some prior art designs such as "Kitslink," a single male dovetail projecting beyond the sides of the construction element does not allow the blocks to stand level by themselves. In the preferred embodiment of the invention, paired connection elements are used. Anti-twist bars, which are extensions of the female connection element, project outward the same distance as the male ribs, and this allows single blocks to be placed level on the sides containing the snap-fit connection elements. The connection elements also preferably extend the full height of each face, which results in even more stability when they are stood on their sides.

(v) allows use of an extra connection locking device. Some prior art such as "Tatum" and "Kitslink" use dovetail connection elements that result in a very rigid connection that doesn't come apart as readily as a snap-fit connection in general. But these systems are prone to damage through rough handling. In the invention, especially when used in larger construction systems, a wedge spacer can be inserted in the space between the male ribs, which prevents the connection element from separating in all six spatial directions. The ridges and projections holding together the connection however are much less in height than the typical dovetail, which still reduces the chances of damage to the connection over the dovetail connections mentioned when connection elements are forced apart.

SUMMARY

A modular construction system featuring an improved snap-fit connection system that can be incorporated into a wide variety of modular type construction elements. In the invention, all connection elements are of two categories. First they may be either male or female, where the male is a rib-like member than enters a female recess. Secondly the two mating connection elements can also be of either type one or type two. In all embodiments of the invention, the definition of a type one connection is that it contains ridges and indentations and is the more resiliently bendable connection element, while the definition of a type two connection is that it contains grooves and projections and is the less resiliently bendable connection element.

In the preferred embodiment of the invention, the type one connection is male and consists of a pair of flexible ribs containing ridges and indentations. These ribs snap-fit into the recess of the type two connection element which is female, consisting of rigid opposed walls which contain grooves and projections. When the connection elements are engaged, the paired ribs fit tightly between the opposed walls which prevents movement in the horizontal direction. The ridges on the ribs locate into the grooves of the opposed walls which prevents movement in the longitudinal direction. The indentations in the ridges locate over the projections in the grooves and this prevent movement in the vertical direction. The female connection element is open on the top, bottom, and front faces. In the preferred embodiment, this allows the connection element to be either slid together vertically from the top or bottom, or longitudinally from the front, or the connection elements can be rolled together. The connection elements can also be separated by the reverse procedure.

The connection element of the invention is superior to the prior art, as centrally located indentations and projections are used to prevent the connection from sliding apart. Other connection systems in this general snap-fit class use projections on the open sides of a female connection element, which are more difficult to assemble. Other novel aspects of the invention allow for a much larger variety of construction elements than the prior art. Many snap-fit type connection elements are considered to be hard to mold, but this connection element both can be engaged or separated easily in a variety of directions while still being able to be molded inexpensively.

DRAWINGS—FIGURES

The invention will now be described, by way of example only, with reference to the accompanying drawings, of which:

FIG. 69 is a plan view comparison between a dovetail connecter and a snap-fit connecter;

FIGS. 70A and 70B are two plan views of generic embodiments of type one and type two connection elements showing the scope of the invention.

DRAWINGS—REFERENCE LETTERS AND NUMBERS

Figure 1:
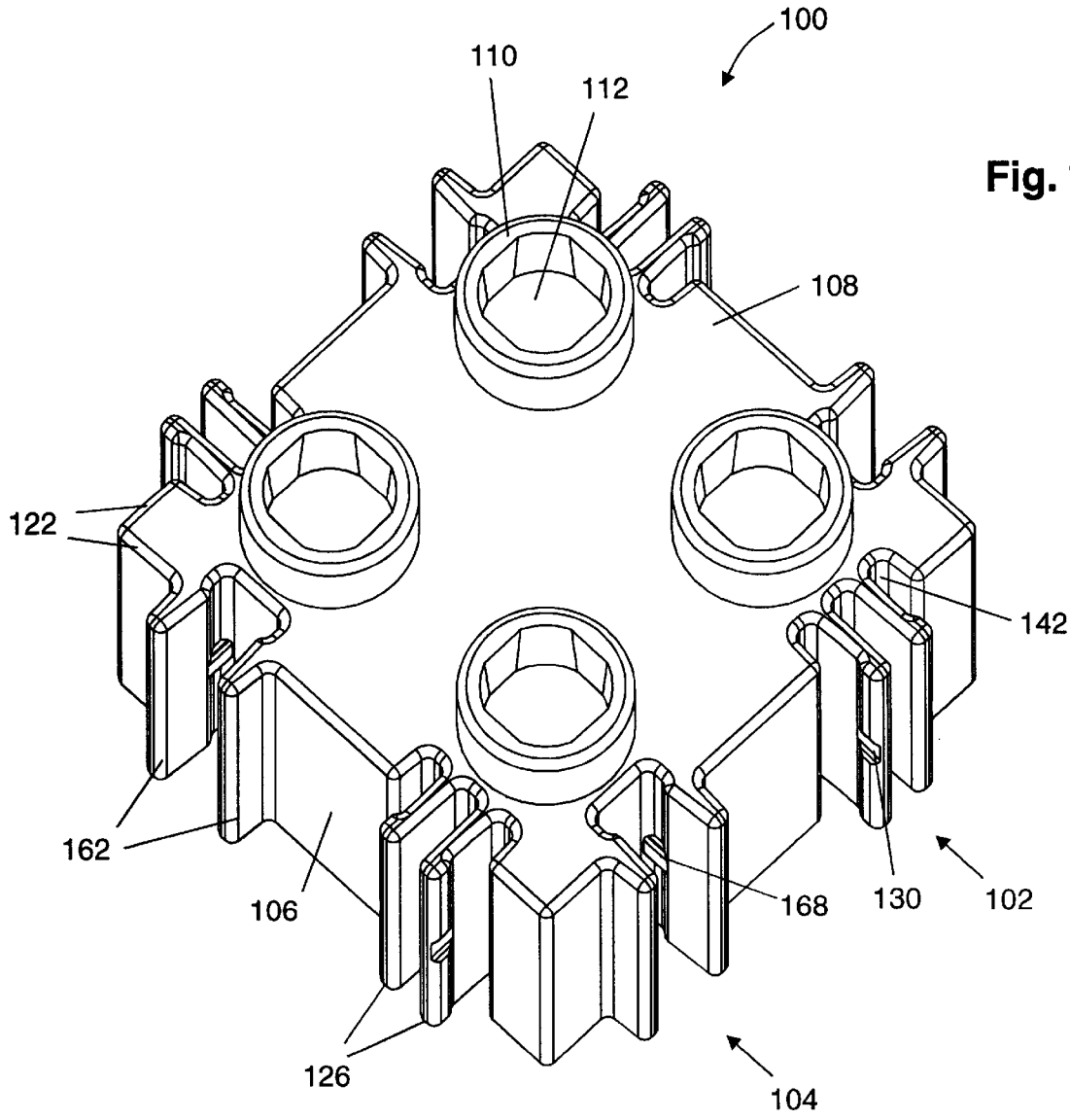
FIGS. 1 to 3 are respectively perspective views of the top, bottom, and a single side face view of the preferred embodiment "paired-snap" block type construction element, showing paired snap-fit connection elements on faces.

X horizontal direction
Y vertical direction
Z longitudinal direction
100 paired-snap construction element
102 male connection element, various embodiments
104 female connection element, various embodiments
106 side surface, paired-snap construction elements
108 top surface
110 stud wall
112 stud cavity
113 cavity stud contact
114 bottom surface
116 tubular wall
118 tubular wall stud contact
120 interior walls, preferred embodiment
122 top radius, all construction elements
123 bottom radius, all construction elements
124 inner wall stud contact
126 rib, male type one connection element
127 rib end surface, male type one connection element
128 ridge, type one connection element
129 ridge outer surface, type one connection element
130 indentation, type one connection element
132 ridge ramp, type one connection element
134 ridge ramp radius, type one connection element
136 rib outside surface, male connection element
138 rib cavity, male connection element
140 ridge outer radius, male connection element
141 rib inner radius, male connection element
142 depression, various embodiments
143 depression end surface, various embodiments
144 depression outer surface, various embodiments
146 indentation upper ramp, type one connection element
148 indentation vertical flat, type one connection element
150 indentation lower ramp
151 opposed walls, female connection element
152 recess, female type two, various embodiments
154 groove, type two connection element
155 groove outer surface, type two connection element
156 endwall, female connection element
157 groove ramp, type two connection element
158 groove ramp radius, type two connection element
160 opposed wall surface, female connection element
161 anti-twist bar angle
162 anti-twist bar, female connection element
163 anti-twist bar front surface
164 recess inner radius
166 anti-twist bar outer surface
168 projection, type two connection element
170 projection upper ramp, type two connection element
172 projection vertical flat, type two connection element
174 projection lower ramp, type two connection element
176 cavity inside radius, preferred embodiment
178 tubular cavity, paired-snap construction elements
179 tubular cavity contact, paired-snap construction elements
180 rib inner surface
181 rib angle
182 connection radius, common
184 45 degree ridge ramp angle
186 90 degree ridge ramp angle
188 135 degree ridge ramp angle
190 bulbous ridge ramp
192 45 degree groove ramp angle
194 90 degree groove ramp angle
196 135 degree groove ramp angle
198 bulbous groove ramp
200 45 degree indentation upper ramp
202 45 degree indentation lower ramp
204 90 degree indentation upper ramp
206 45 degree indentation lower ramp
208 135 degree indentation upper ramp
210 45 degree indentation lower ramp
212 45 degree projection upper ramp
214 45 degree projection lower ramp
216 90 degree projection upper ramp
218 45 degree projection lower ramp
220 135 degree projection upper ramp
222 45 degree projection lower ramp
224 square ribs, connecter lead-in
225 square rib, connecter lead-in
226 divergent opposed walls, connecter lead-in
227 divergent recess, connection lead-in
228 angled ribs, connection lead-in
229 tapered rib, connection lead-in
230 square recess edge, connection lead-in
231 square recess, connection lead-in
232 radiused ribs, connection lead-in
233 radiused rib, connection lead-in
234 recess radius, connection lead-in
235 parallel opposed walls, connection lead-in
236 parallel recess, connection lead-in
237 longitudinal engagement
238 rocking point
240 vertical engagement
242 rectangular construction element, paired-snap
244 equilateral triangle construction element, paired-snap
246 pie shaped construction element, paired-snap
248 right isosceles triangle construction element, paired-snap
249 beam construction element, paired-snap
250 single-snap construction element, square
251 side surface, single-snap
252 rectangular construction element, single-snap
254 equilateral triangle construction element, single-snap
256 pie shaped construction element, single-snap
258 right isosceles triangle construction element, single-snap
260 six sided polygon construction element, single-snap
262 beam construction element, single-snap
264 female split-snap connection element, type two
266 side A rib, split-snap

268 side B rib, split-snap
270 split-snap construction element, square block
272 short split-snap construction element
274 long split-snap construction element
275 filler construction element, split-snap
276 side surface, female split-snap
278 beam hole
280 beam construction element, split-snap
282 180 degree radial-hub construction element
284 90 degree radial-hub construction element
286 straight radial-hub construction element
288 hole, radial-hub
290 radial-hub construction element, female type two, 360 degree
292 side surface, female radial-hub
294 strut body, radial-hub
296 male split-snap connection element, type one
298 side surface, male radial-hub
300 strut construction element, radial-hub
302 rod construction element, radial-hub
304 rod body, radial-hub
306 wire construction element, radial-hub
308 wire body, radial-hub
310 rib, split-snap male type one
312 panel one construction element
314 sheet, panel one
316 panel three construction element
318 divider, panel three
320 panel two construction element
322 panel four construction element
324 panel tab, panel four construction element, female type two
326 gap, panel four construction element, female type two
328 groove, panel four construction element, female type two
330 stud plate construction element
332 stud, stud plate construction element
334 sidepin plate construction element
336 side pin, sidepin plate construction element
338 plate, tab plate construction element
340 tab plate construction element
342 holes, tab plate construction element
344 plate, split plate construction element
346 holes, split plate construction element
348 floor panel, split plate construction element
350 split plate construction element
352 window construction element
354 single-snap plate, window construction element
356 window, window construction element
358 wedge spacer radius
360 wedge spacer construction element
362 protrusion, wedge spacer construction element
364 rib notch, wedge spacer construction element
366 long wedge spacer construction element
368 side C ribs, split-snap rotator
370 split-snap rotator
372 side D ribs, split-snap rotator
374 XZ rotator
376 side E, XZ rotator
378 side F, XZ rotator
380 Y rotator
382 side G, Y rotator
384 side H, Y rotator
386 side J, pivot rotator
388 side K, pivot rotator
390 pivot rotator
392 pin, pivot rotator
394 robot hand construction element
396 "Lego Duplo"
398 "Lego Classic"
400 stud adaptor construction element
402 "Morphun"
404 "Kitslink"
406 wedge spacer punch, pry tool
408 tip radius, pry tool
410 pry tool
412 vertical hole, vertical hole construction element
414 countersink, vertical hole construction element
416 snap pin
418 threaded rod
420 vertical hole construction element
422 letter
424 rib with slots, male type one
426 rib, rib with slots
427 slot, rib with slot
428 upper slot ramp, rib with slots
429 lower slot ramp, rib with slots
430 paired-snap channel construction element
432 channel, paired-snap channel construction element
434 tubular column, paired-snap channel construction element
435 ridge, tubular column
436 channel, single-snap channel construction element
438 ribs, single-snap channel construction element
440 single-snap channel construction element
442 construction element, no anti-twist bar and no depression
443 construction element, no anti-twist bar but with depression
444 connection element, female type two, no anti-twist bar
446 snap-fit connection element
448 dovetail connection element
450 generic male type one connection element, flexible ribs
452 generic female type two connection element, rigid walls
454 generic male type two connection element, rigid ribs
456 generic female type one connection element, flexible walls
458 ribs, male type one, flexible ribs
460 rib cavity
462 ridge, male type one
464 indentation, male type one
466 generic connection radius
468 recess, female type two
470 opposed walls, female type two, rigid walls
472 groove, female type two
474 projection, female type two
476 rib(s), male type two, rigid
478 groove, male type two
480 projection, male type two
482 recess, female type one
484 opposed walls, female type one, flexible walls
486 ridge, female type one
488 indentation, female type one
490 rib cavity, rigid rib

DESCRIPTION—FIGS. 1–23—PAIRED-SNAP

Many construction elements can be designed around the basic snap-fit connection system of the invention. Only some of the embodiments of the snap-fit connection element and the variously shaped construction elements that are possible are discussed in the sections that follow. The preferred embodiment of the snap-fit construction system is shown in this first section and will most fully describe the details of the snap-fit connection element and also its operation.

Figure 2:
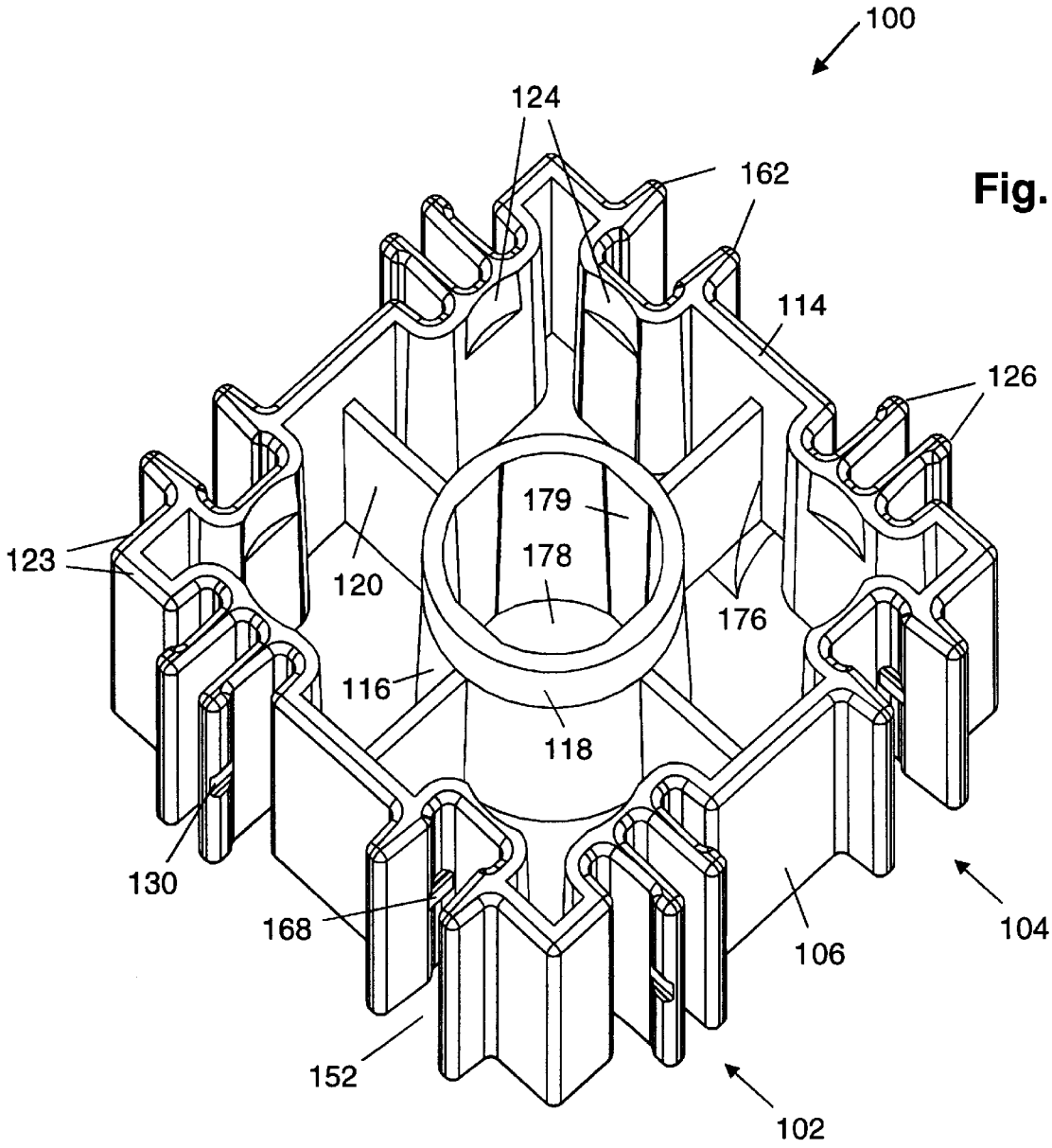

As shown in FIGS. 1 and 2, the preferred embodiment of the invention is a paired-snap construction element 100 in the form of a block, which has a generally parallelepiped hollow configuration allowing for easy molding. The paired-snap construction element 100 has connection elements on a top surface 108, a bottom surface 114, and a plurality of side surfaces 106.

Figure 3:
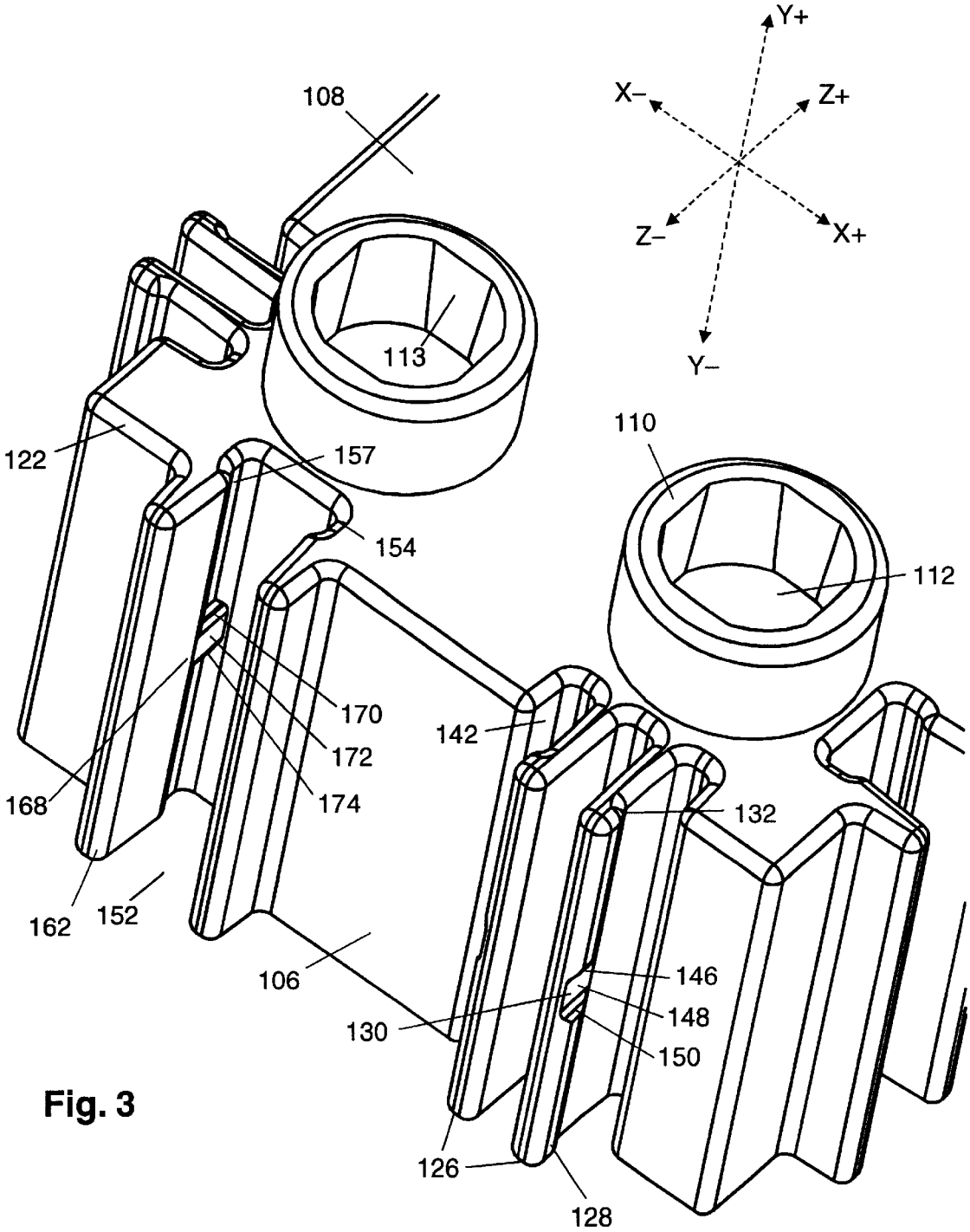

The directional orientation of all connection elements relate to a head on view of the single side surface 106 of the paired-snap construction element 100 as shown in FIG. 3. Each pair of positive and negative spatial directions of the connection securing is shown in the spatial diagram. The directional names are defined as X for a horizontal direction, Y for a vertical direction, and Z for a longitudinal direction. It should be appreciated however that all the construction elements can be and are used in any orientation.

Stud connection elements are used for connecting the top surfaces 108 and the bottom surfaces 114 together. A raised stud wall 110 with a stud cavity 112 are located on the top surface 108. The stud cavity 112 has four stud cavity contacts 113, which are symmetrically positioned flat parallel surfaces on its sidewall to be able to connect frictionally to small studs or tubes of other construction elements. The remaining areas of the stud cavity 112 can be tapered to allow for easier ejection from the mold.

A tubular wall 116 depending from the walls of the top surface 108, passes through the paired-snap construction element 100 to approximately the plane of the bottom surface 114. A tubular cavity 178 is located in the center of the tubular wall 116 which has four tubular cavity contacts 179, which are symmetrically positioned flat parallel surfaces on its sidewall to be able to connect frictionally to rods and pins of other construction elements. The remaining areas of the tubular cavity 178 can also be tapered to allow for easier ejection from the mold.

A plurality of interior walls 120 are located on the interior of the paired-snap construction element 100 and provide additional strength and reinforcement. The interior walls 120 depend from the walls of the side surfaces 106, the walls of the top surface 108, and the tubular wall 116, and pass through the interior of the paired-snap construction element 100 approximately three quarters of the distance from the walls of the top surface 108 to the plane of the bottom surface 114. The length of the interior walls 120 in the vertical direction Y may however be varied from zero to the full distance between the walls of the top surface 108 and the bottom surface 114. The tubular wall 116 however ideally projects nearly to the bottom surface 114 because it provides a tubular wall stud contact 118, which is a first stud contact, on its exterior surface. An inner wall stud contact 124 is present for providing the remaining two of three stud contact surfaces for frictionally connecting to the stud walls 110 of a connecting paired-snap construction element 100. The inner wall stud contacts 124 ideally are only slightly longer vertically than the mating stud walls 110 are in length, allowing the remaining wall of the side surface 106 in the direction towards the top surface 108 to have a greater wall thickness. A cavity inside radius 176 in the interior of the paired-snap construction element 100 between the walls of the top surface 108 and the walls of the side surfaces 106 and the interior walls 120, as well as between the interior walls 120 and the walls of the side surface 106, helps to increase the impact resistance of the construction element.

In the invention, all snap-fit connection elements are of two categories. First they may be either male or female, where the male is a rib-like member than enters a female recess. Secondly the two mating connection elements can also be of either type one or type two. In all embodiments of the invention, the definition of a type one connection is that it contains ridges and indentations and is the more resiliently bendable connection element, while the definition of a type two connection is that it contains grooves and projections and is the less resiliently bendable connection element. In this preferred embodiment as well as most alternate embodiments, the type one connection element is male and the type two connection element is female.

Figure 4:
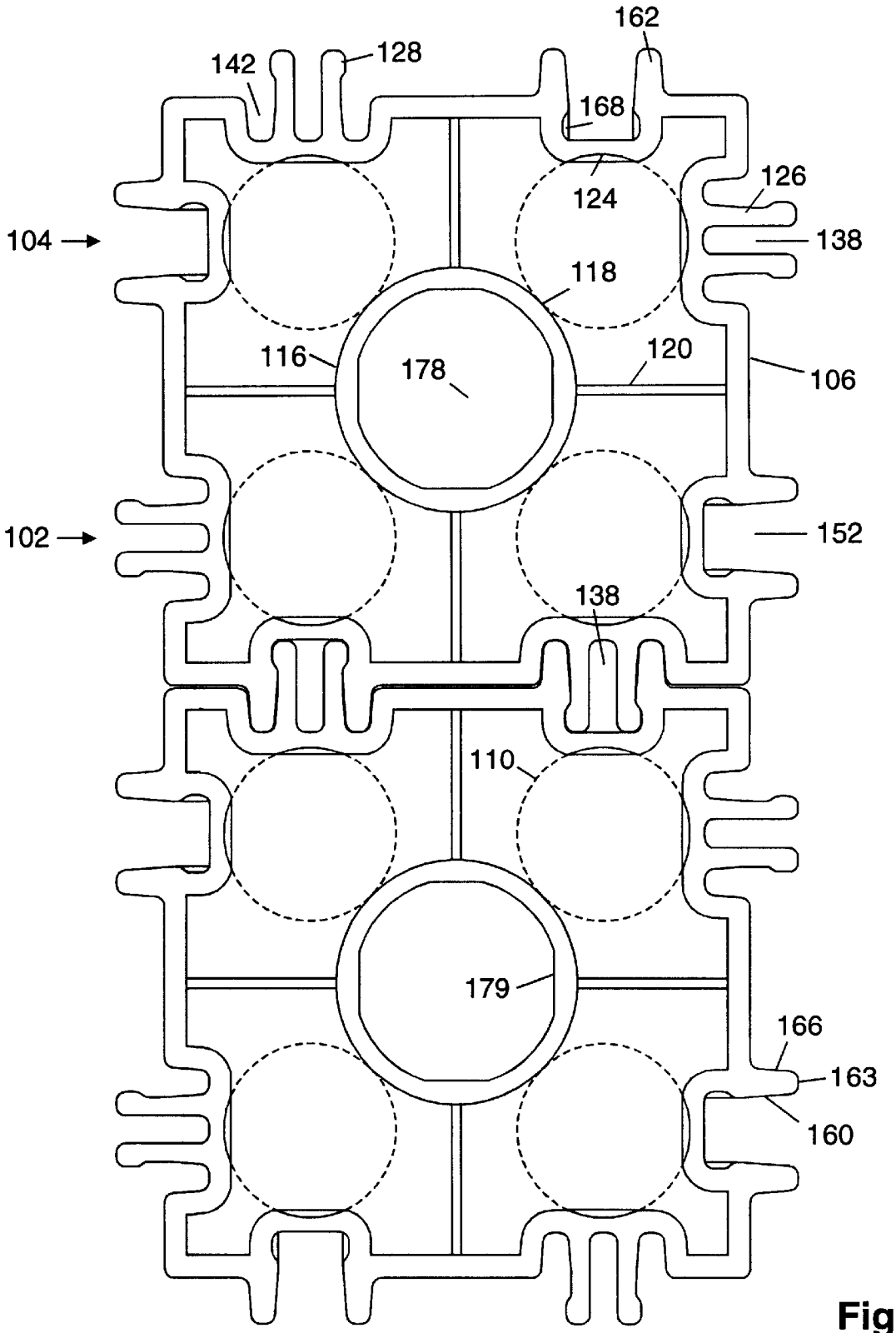
FIG. 4 shows a bottom plan view of two construction elements of the preferred embodiment joined together.
Figure 5:
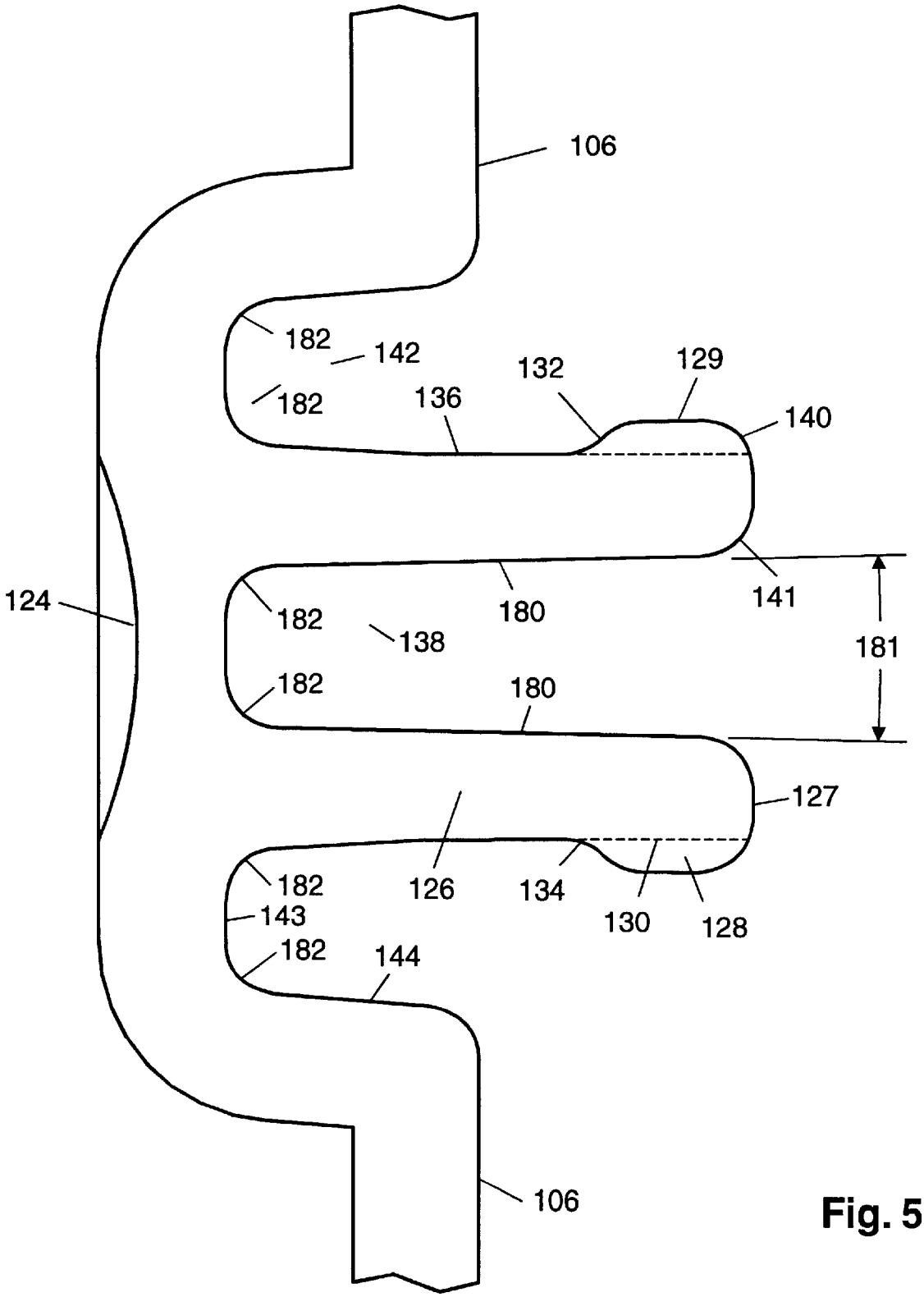
FIG. 5 is a large detailed plan view of a male type one connection element of the preferred embodiment.

A male type one connection element 102, as shown in FIGS. 1 to 7, comprises of a pair of ribs 126 extending outward in the longitudinal direction Z from a depressed position below the side surface 106 of the paired-snap construction element 100. By extending from a depressed position, the ribs 126 can generally be made longer in the longitudinal direction Z. This allows the ribs 126 to be more flexible for a certain rib thickness in the horizontal direction X and also results in a wide range of advantages in this application. A depression 142 is located adjacent to each outermost surface of the ribs 126. This depression 142 is as deep as the distance the ribs 126 extend past the plane of the side surface 106. As shown in FIG. 5, the depression 142 contains a depression end surface 143, which is used as a stop, and a depression outer surface 144, which is angled outward.

A ridge 128 protrudes outward in the horizontal direction X from each outermost side of the ribs 126. Each ridge 128 contains a ridge ramp 132 which is angled at 45 degrees to the horizontal direction X in the XZ plane.

As shown in FIG. 3, an indentation 130 is located on each of the ridges 128. The indentation 130 has an indentation vertical flat 148, which extends in the vertical direction Y, an indentation upper ramp 146, and an indentation lower ramp 150. Both the indentation upper ramp 146 and the indentation lower ramp 150 slope away from the indentation vertical flat 148 at an angle of 45 degrees to the vertical direction Y in the XY plane. The indentations 130 on each of the ribs 126 are both of the same height in the vertical direction Y and located in the vertical center of the ridges 128.

A female type two connection element 104, as shown in FIGS. 1 to 7, comprises of a pair of opposed walls 151 extending inwards from the side surface 106 in the longitudinal direction Z and ending at an endwall 156. The void between the opposed walls 151, the endwall 156, and extending outwards is a recess 152, which is open at its top, bottom and an outward face.

Figure 6:
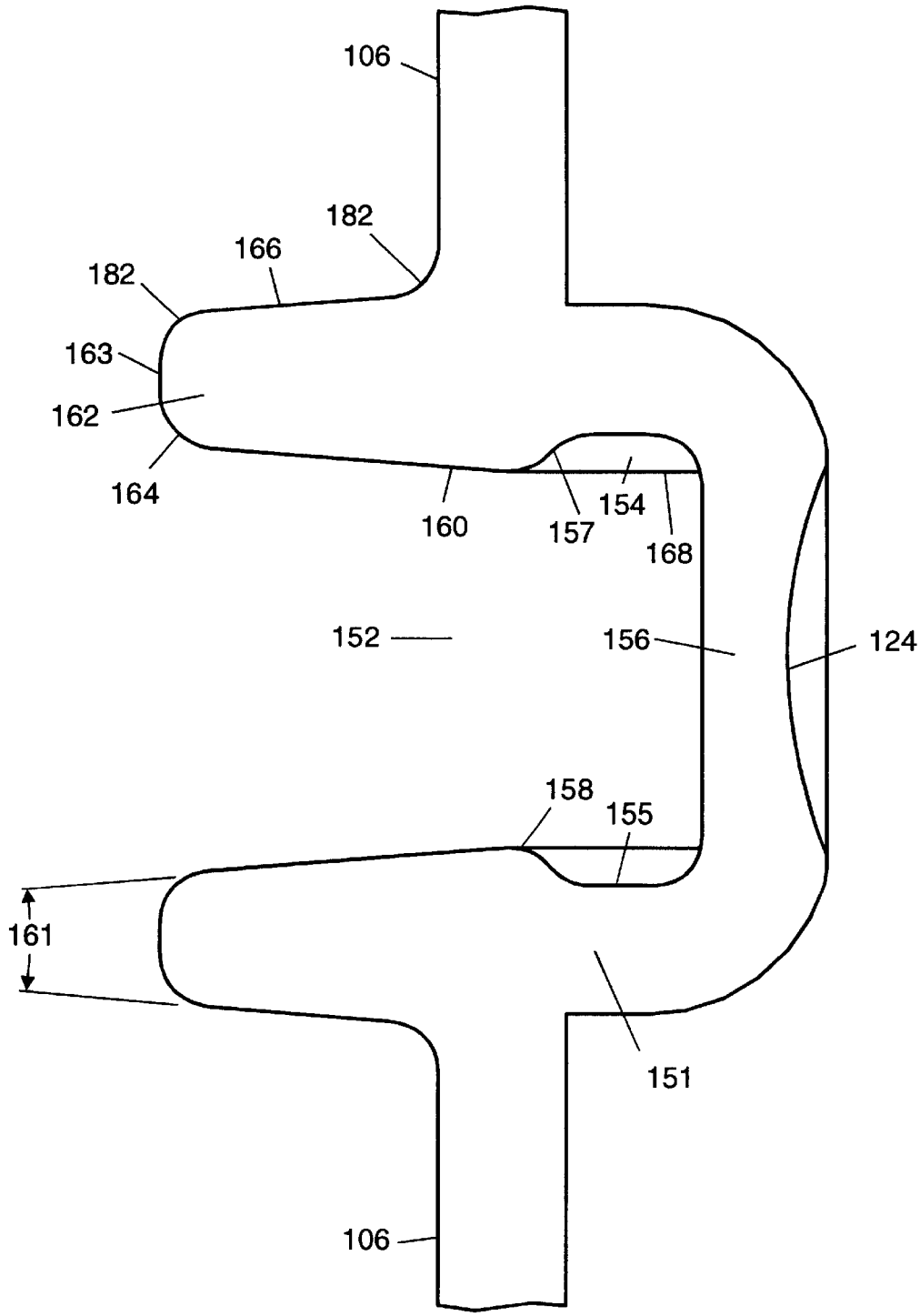
FIG. 6 is a large detailed plan view of a female type two connection element of the preferred embodiment.

A groove 154 is located in each of the opposed walls 151 nearest the endwall 156 and runs in the vertical direction Y. This groove 154 contains a groove ramp 157 as shown in FIG. 6. The groove ramps 157 are also angled at 45 degrees to the horizontal direction X in the XZ plane, such that when the male connection element 102 and female connection element 104 are engaged, counterpart angled surfaces of the ridge ramps 132 and the groove ramps 157 fit flush against each other.

A projection 168 is located in each groove 154 as is illustrated in FIG. 3. The projections 168 have a projection vertical flat 172, which extends in the vertical direction Y, a projection upper ramp 170, and a projection lower ramp 174, which both slope away from the projection vertical flat 172 at an angle of 45 degrees to the vertical direction Y in the XY plane. The projections 168 are located in the vertical center of each groove 154 to match up with the positioning of the indentations 130 on the ridges 128. The projections 168 extend out from the grooves 154 in such a way as to mate perfectly with the shape of the indentations 130 in the ridges 128 when engaged.

As shown in FIGS. 4 to 7, the opposed walls 151 extend past the plane of the side surface 106 to become a pair of anti-twist bars 162 which provide additional torsional stability to engaged construction elements as well as preventing movement in the horizontal direction X. They also fill up the space of the depressions 142 and this results in a clean look. The anti-twist bars 162 and the ribs 126 extend an equal distance past the plane of the side surface 106 of the paired-snap construction element 100, which allows the construction element to sit level when placed on its side. The anti-twist bars 162 are tapered. The anti-twist bar 162 contains an anti-twist bar outer surface 166 and an opposed wall surface 160, which are angled inward with an anti-twist bar angle 161 such that the pair of anti-twist bars 162 become narrower as they project in the longitudinal direction Z from the paired-snap construction element 100. Having the anti-twist bar angle 161 at about 9 degrees is ideal. An anti-twist bar front surface 163 is used as a stop. The depressions 142 become narrower as they penetrate into the paired-snap construction element 100. The tapered anti-twist bars 162 fit into the depressions 142 with a small amount of side clearance, which allows for easier engagement and separation.

Figure 7:
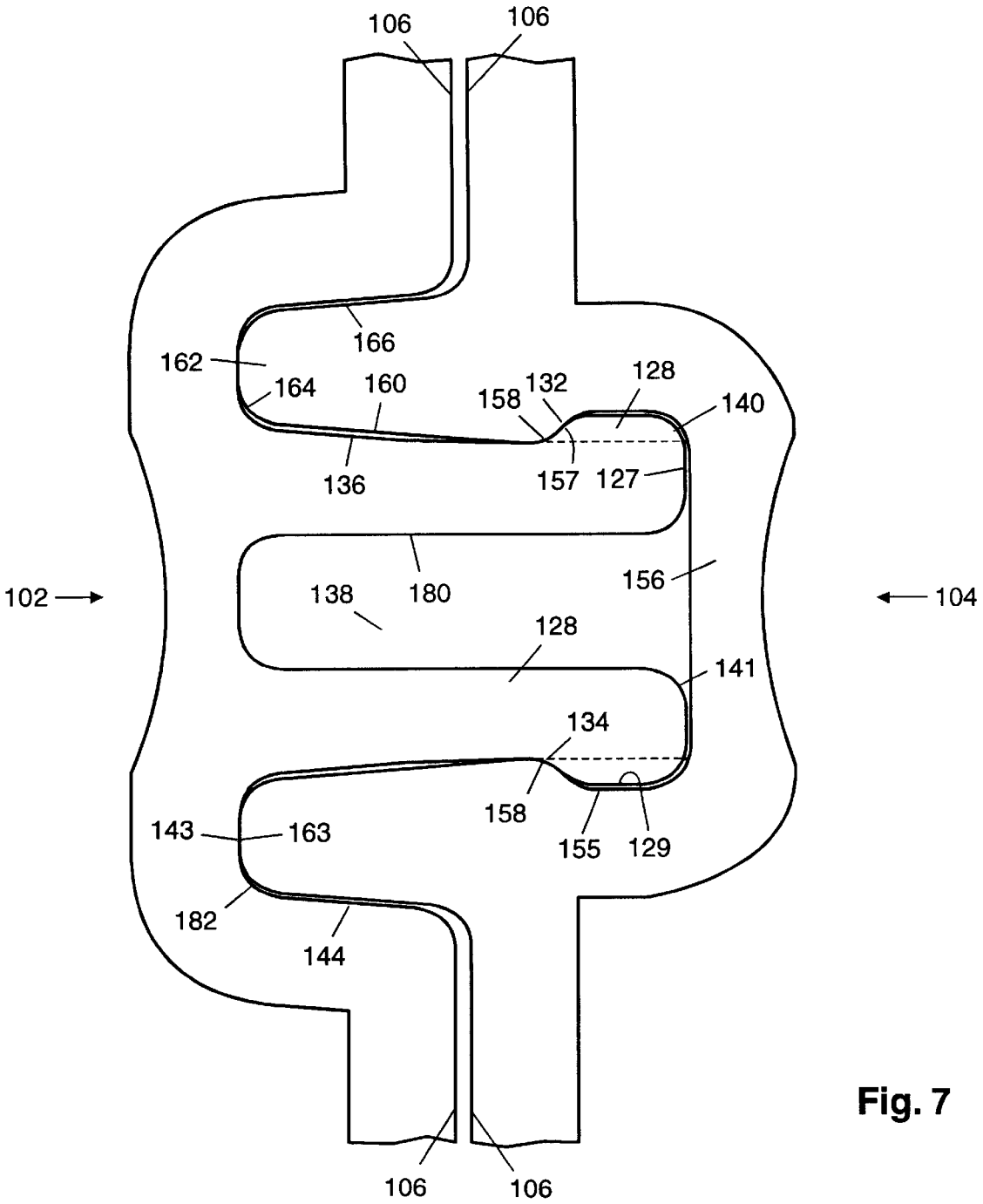
FIG. 7 is a large detailed plan view of the preferred embodiment of the invention showing a male type one and a female type two connection element engaged.

When the male connection element 102 is engaged within the female connection element 104, the ribs 126 do not snap back to their unengaged state. They continue to press against the opposed walls 151. They are designed to have what can be called a preload. Ideally a rib cavity 138 should be parallel after engagement. In this case a pair of rib inner surfaces 180 and the rib cavity 138 will need to be divergent towards the free ends of the ribs 126 in the unengaged state. As shown in FIG. 5 to 7, a rib angle 181 of about 2.5 degrees is ideal when the male connection element 102 is not engaged. The paired-snap construction element 100 has a preload force of approximately 25% of the maximum flexing force experienced during engagement. This amount of preload works best for toys.

Figure 13:
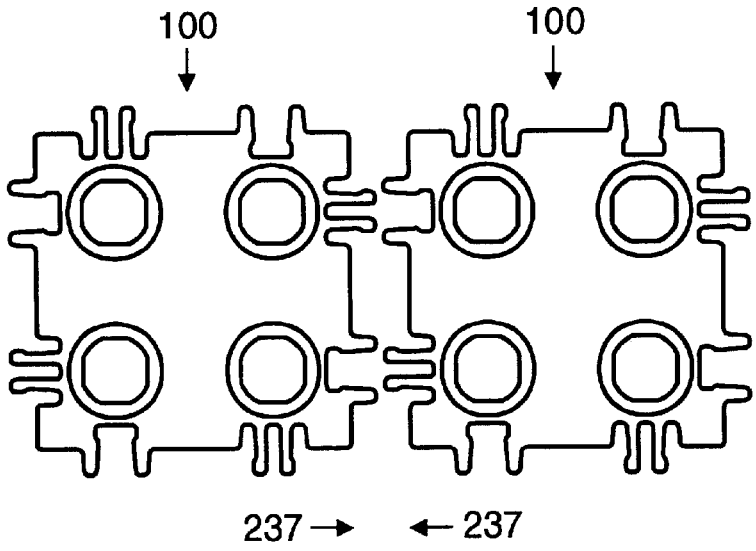
FIGS. 13 to 15 are various plan views of two of the construction elements of FIG. 1 shown in various stages of connection.
Figure 14:
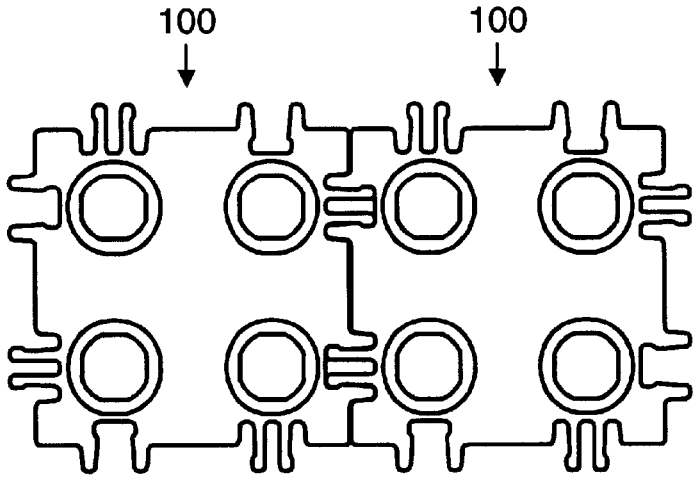

The opposed wall surfaces 160 of the female connection element 104 are divergent is they extend outward in the longitudinal direction Z. A longitudinal engagement 237 of two construction elements, as shown in FIG. 13 is easier when the ribs 126 can partly engage into the recess 152 in their non bent state. The slight angle of the opposed wall surfaces 160 gradually bends the ribs 126 together as they are inserted into the recess 152.

As shown in FIGS. 5 to 7, the ribs 126 have a rib outside surface 136, which is angled to roughly match that of the opposed wall surfaces 160. A close fit results in greater rigidity of the connection elements in both torsion and the horizontal direction X. However, to avoid hang-ups of the male connection element 102 and the female connection element 104 due to parting line flashing and unevenness of the parts from the molding operation, small clearances exist between many of the mating surfaces. So it is ideal to have a small clearance between the rib outside surface 136 and opposed wall surface 160, as the ribs 126 should rather contact at the groove ramp 157 and the ridge ramp 132. Ideally there is also a very small amount of clearance between a ridge ramp radius 134 and a groove ramp radius 158. There should also be clearance between a groove outer surface 155 and a ridge outer surface 129, as well as between a rib end surface 127 and the endwall 156.

Figure 18:
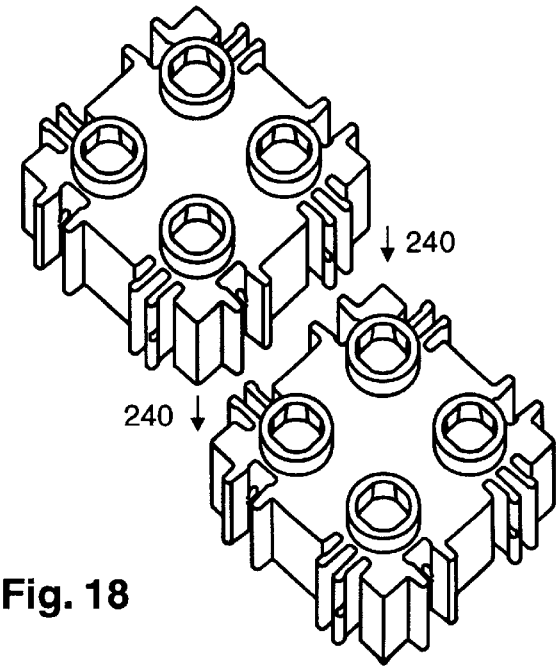
FIG. 18 is a perspective view of two of the construction elements of FIG. 1 in position to be engaged by vertically sliding the snap-fit connection elements together.
Figure 19:
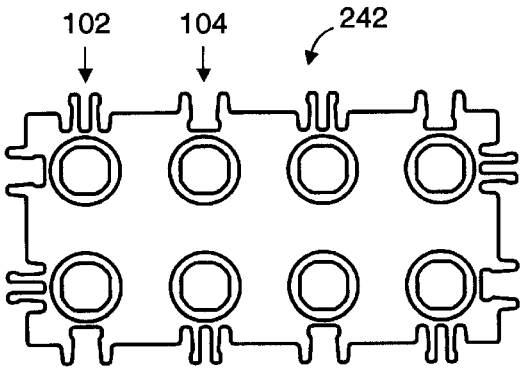
FIGS. 19 to 22 show top views of some of the different shapes of construction elements possible with the paired-snap design of FIG. 1.
Figure 20:
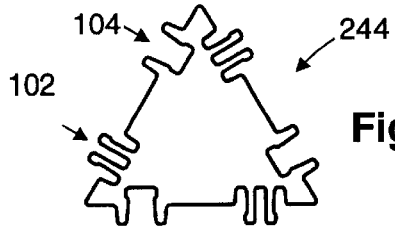
Figure 21:
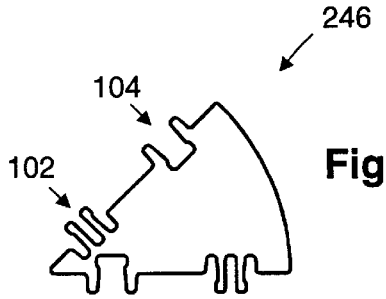
Figure 22:
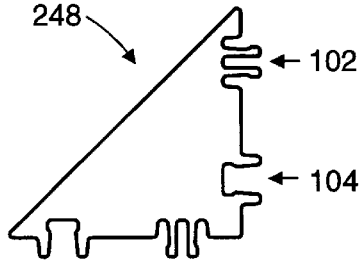
Figure 23:
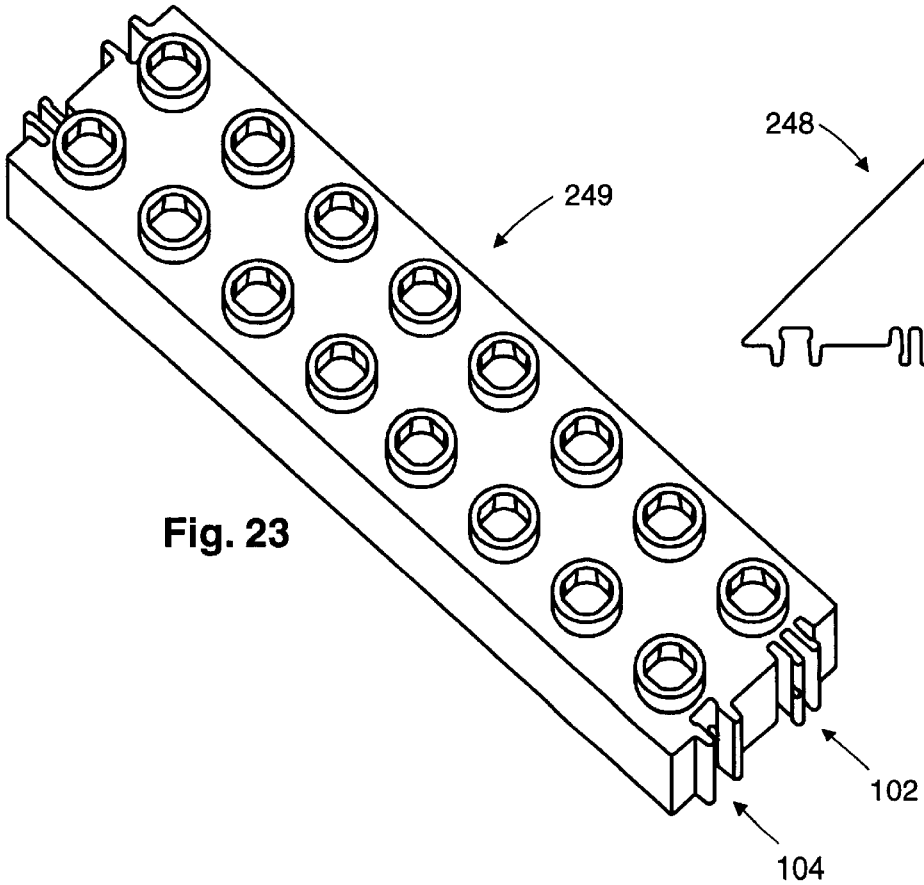
FIG. 23 is a perspective view of an alternate embodiment beam construction element with the paired-snap design of FIG. 1.

Various radiuses on the construction element exist for both functional and esthetic reasons. A top radius 122 along the edge of the top surface 108, as well as a corresponding bottom radius 123 at the edge of the bottom surface 114 of the paired-snap construction element 100, extends all the way along the side surfaces 106 as well as around the male connection element 102 and the female connection element 104. The rounded edges are quite pleasing to the eye, but also are designed to prevent harm to those handling the construction element. The connection and construction element wall thicknesses are designed to be of a large enough dimension that they can accept a uniform and continuous radius around the entire edge, which results in a pleasant uniform look. Another purpose of the top radius 122 and the bottom radius 123 is to provide a rounded edge for a vertical engagement 240 of two paired-snap construction elements 100 as shown in FIG. 18. The rounded edges of the female connection element 104 enlarge the opening, and the rounded edges of the male connection element 102 thin the edges, allowing the connection elements to be aligned easier and act like small ramps to gradually compress the ribs 126 together when they are being inserted into the female recess 152. Likewise, in the longitudinal engagement 237, the connection elements are aligned easier because the front edge of the rib 126 contains a ridge outer radius 140 and the anti-twist bar 162 contains a recess inner radius 164.

Figure 16:
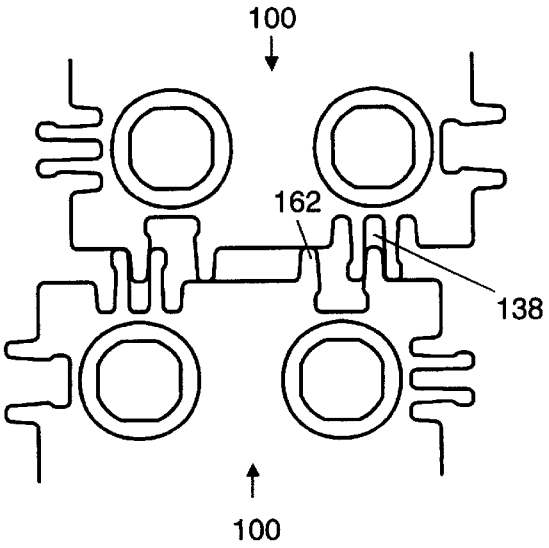
FIGS. 16 and 17 are plan views of two of the construction elements of FIG. 1 shown in a misengaged state.
Figure 17:
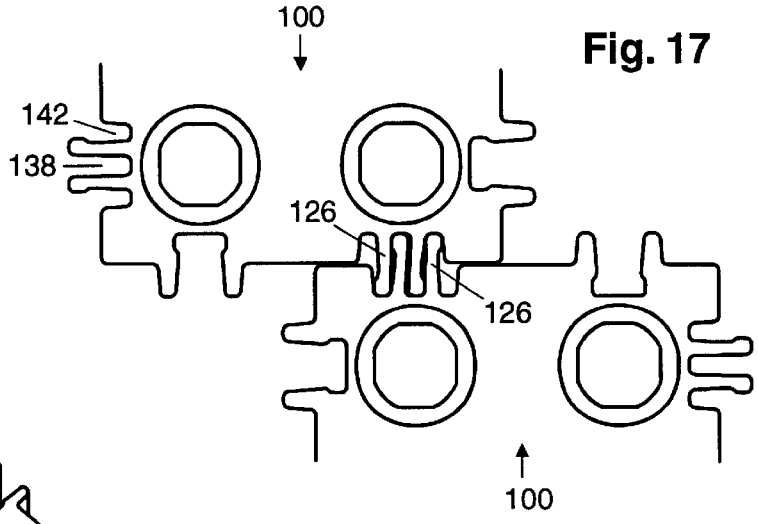

The width in the horizontal direction X of the rib cavity 138, the depression 142, and the anti-twist bar 162 are dimensioned so that they can interfit without damaging the connection elements in case the paired-snap construction elements 100 are misassembled. In FIG. 16, the anti-twist bar 162 is shown inside the rib cavity 138. Ideally the rib cavity 138 is sized so that the ribs 126 would not need to spread outward much at all, reducing the stress on the ribs 126. In FIG. 17, two of the ribs 126 are shown inside the depression 142 and the rib cavity 138. Ideally here as well, the rib cavity 138 and the depression 142 should be sized so that the ribs 126 fit easily into them and that the ribs 126 would not need to spread outward much at all, again reducing stress on the ribs 126. If properly sized for a slight compression fit, the insertion shown in FIG. 17 can be used as a type of weak connection. A rib inner radius 141 and the ridge outer radius 140 match a connection radius 182, found at the base of the ribs 126 and outside of the anti-twist bar 162, and this also reduces the stress on the connection elements when they are misassembled.

The ribs 126, the depression 142, the grooves 154, and the anti-twist bars 162, travel the full height of the paired-snap construction element 100 from the bottom surface 114 to the top surface 108. This results in the strongest connection and is the most pleasing to the eye because the connection elements are flush with the top surface 108 and the bottom surface 114 of the construction element when engaged.

Figure 58:
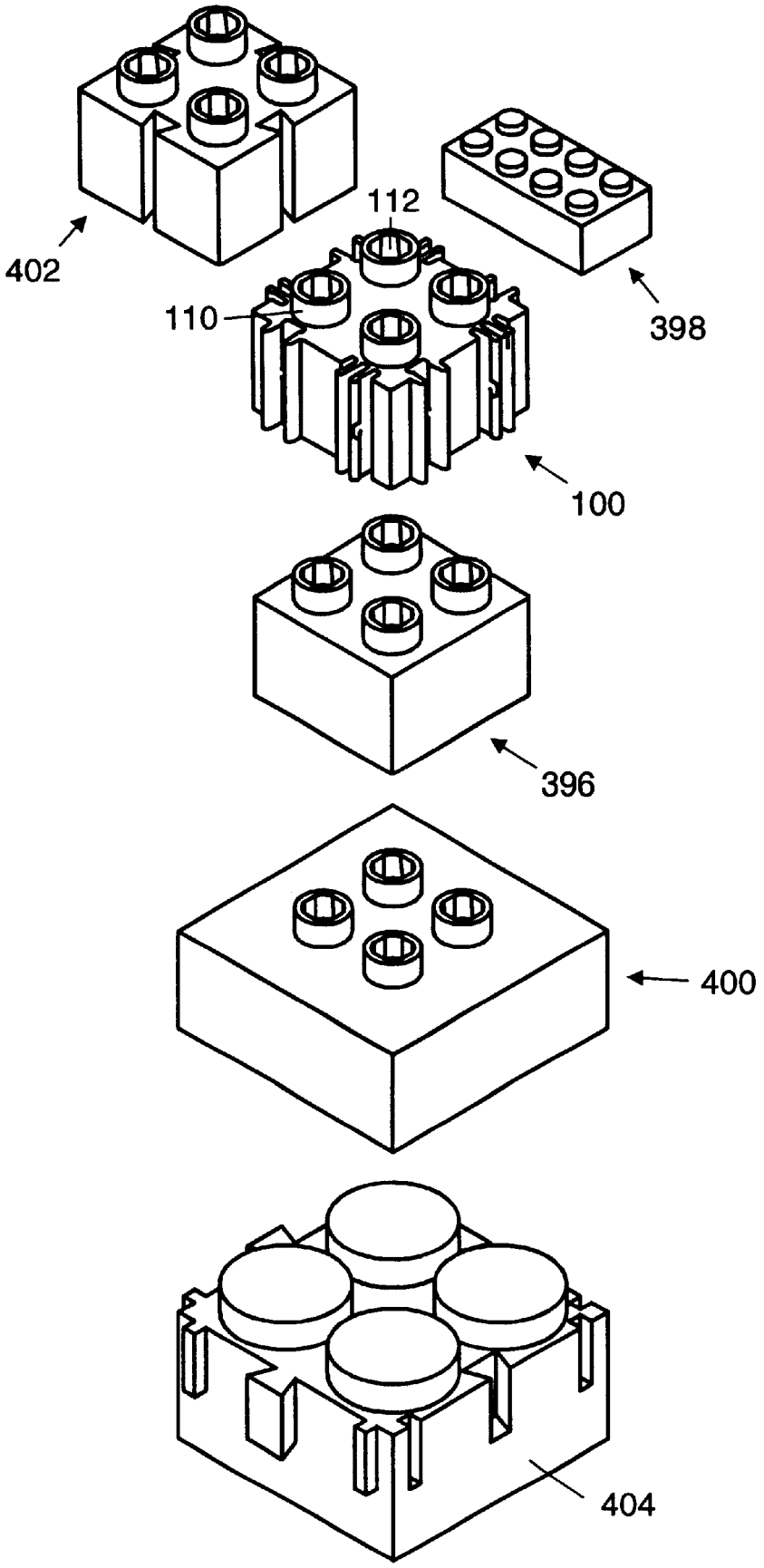
FIG. 58 is a perspective view showing how the preferred embodiment can be engaged to other construction elements by inherent features and adaptors.

Through the use of all the connecting elements just described, the paired-snap construction element 100 may be joined on all faces, and all faces can be secured in six of six possible spatial directions. A combination of studs and snap-fit connection elements are used because this results in the paired-snap construction element 100 being easy to mold, as all the features are generally collinear. The stud walls 110 and the stud cavities 112 provide compatibility with other construction systems. For example when the paired-snap construction element 100 has the same basic block and stud dimensions as "Lego Duplo" 396, the outer surface of the stud walls 110 can connect to the "Lego Duplo" 396 blocks and the stud cavities 112 can be used to connect to the tubes of the smaller "Lego Classic" 398 construction elements. Various prior art construction elements are illustrated in FIG. 58.

The stud connection system connects together through friction between the contact faces. The stud dimensions are sized to fit with interference between the confines of the mating stud wall 110, the inner wall stud contacts 124, and the tubular wall stud contact 118. One of the problems with molding a hollow construction element is that it is difficult to keep the walls parallel during molding. This can greatly affect the position of the inner wall stud contacts 124 and results in either the stud connection being loose or too tight. The interior walls 120 greatly increase the dimensional stability of the sidewalls. Polypropylene is also a good material for the construction elements because it is more stable dimensionally in this regard during molding than other materials such as Acetal or Styrene. Using the tubular wall 116 is quite desirable and is also used on many prior art construction systems. It allows construction elements to be joined with as little as one stud in contact.

Engagement on the side surfaces 106 of the paired-snap construction element 100 is achieved in six of six possible spatial directions by way of the snap-fit connection elements in the following way shown in FIGS. 3 to 7. The pair of male ribs 126 secures the two construction elements in the two horizontal directions X+ and X− by fitting into the female recess 152. The actual surfaces that provide resistance in this direction are the ridge ramp 132 and the groove ramp 157. The pair of ribs 126 are pushing apart in opposite directions due to the preload on the ribs. As well the ribs 126 are being constrained from moving apart too far by other contact surfaces that act as stops in the longitudinal direction Z. The connection is secured in the two longitudinal directions Z+ and Z− by the ridge ramp 132 reacting against the groove ramp 157 in one direction and the anti-twist bar front surface 163 reacting against the depression end surface 143. Finally, to secure the connection in the two vertical directions Y+ and Y−, the pair of indentations 130 fit into the pair of projections 168. Because the indentations 130 and the projections 168 have a pair of opposite angled surfaces, this secures the connection in both of these directions. The indentations 130 and ridges 128 are on the same rib 126, so each pair of ribs holds the connection elements together in six spatial directions. The flexural resistance of the ribs 126 is what provides resistance to the connection coming apart.

Each side surface 106 of the paired-snap construction element 100 has both the male connection element 102 and the female connection element 104 positioned so that two construction elements may be engaged as shown in FIGS. 13, 14, 15, 18. The advantage of using paired-snap connection elements is that the construction element does not have to be carefully oriented before insertion, as each side can be engaged to any other side. By angling the opposed wall surfaces 160, having tapered anti-twist bars 162, plus a small amount of clearance between the anti-twist bars 162 and the depressions 142, engagement and separation of adjacent construction elements is made easier. The two construction elements may be engaged or separated in several ways:

(a) By longitudinal engagement 237 as illustrated in FIG. 13, or separation in the reverse direction.

(b) By vertical engagement 240 as illustrated in FIG. 18, where the male connection elements 102 either slide down or up in relation to the female connection element 104, or separation in the reverse direction.

Figure 15:
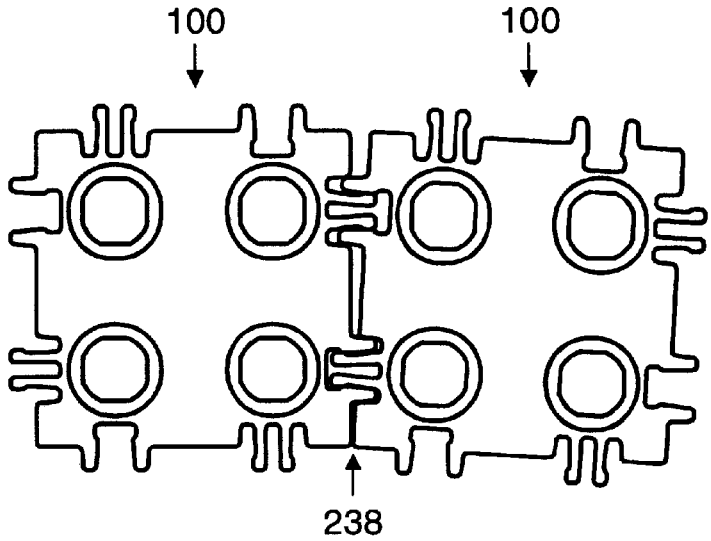

(c) By rolling the two connection elements together in the XZ plane as shown in FIG. 15, where a rocking point 238 acts as a fulcrum during engagement or separation. A first and then a second connection element is pushed together, or separation in the reverse direction.

(d) By rolling the construction elements together in the YZ plane, where first the top or bottom of the construction element is pushed together in the longitudinal direction Z and then the construction elements are rolled together, or separation in the reverse direction.

(e) Through a combination of vertical, horizontal, and longitudinal motion, or separation in the reverse direction.

The combination of the indentations 130 and the projections 168 provides substantial resistance to movement in the vertical direction Y. It is therefore possible to construct significant spans such as bridges or beams in the longitudinal direction Z. In addition, construction elements can be engaged anywhere along the side surfaces 106 of walled structures without removing any construction elements above as in many prior art systems. Construction elements can be engaged onto other construction elements above or below a desired position and then slid up or down in the vertical direction Y to connect with the stud connection system of the desired construction element. It is also possible to join construction elements in a step-like fashion, or between vertical construction elements, with the bottom of the ribs 126 resting on the projections 168. Paired-snap construction elements 100 can also be joined upside down if the joint is staggered in the horizontal direction X.

Having the indentations 130 and the projections 168 near the vertical center of the ribs 126 allows the ribs 126 to be inserted almost half way down the recess 152 before the additional force due to the ribs 126 having to bend over the projections 168 is encountered. By this point the two paired-snap construction elements 100 are well located and parallel at which time a less careful push is required. This makes it easier to assemble than some prior art such as "Lego Znap." The centrally located indentation 130 requires a more ingenious mold design than the prior art, but it makes the connection system easy to use.

In some prior art construction systems, the snap-fit connection elements have a fair amount of play. The snap-fit connection elements in the invention can be designed to have no play or very little play, which has obvious advantages when many construction elements are engaged together. A tight connection with the invention can be achieved because the connection has movable and self-tightening elements in each of the three spatial directions due to the angles that can be used. In the paired-snap construction element 100, a tight connection in both the horizontal directions X+ and X−, as well as the longitudinal directions Z+ and Z− can be achieved because of the 45 degree angular contact of the ridge ramp 132 and the groove ramp 157. As well, the male ribs 126 have a preload, so they are pushing outward in the female recess 152. The ridge ramps 132 slide against the groove ramps 157 till they stop, in which case the connection is tight in both these directions when the appropriate clearances elsewhere are maintained. A tight connection can also be attained due to the ribs 126 being slightly flexible along their length in the vertical direction Y. When considering tolerances, it would be hard to get the ridge ramps 132, the groove ramps 157, as well as all the surfaces of the indentation 130, and the projections 168 to seat with zero clearance. The connection elements however can be designed so that the indentations 130 seat with the projections 168 first. In this case, the ribs 126 being slightly flexible along their height in the vertical direction Y, will be restrained from flexing outward from each other at the vertical center but will be able to flex outward from each other more at the top surface 108 and the bottom surface 114. This allows the ribs 126 to still contact the ridge ramps 132 and the groove ramps 157 at the top surface 108 and the bottom surface 114 of the connection in such a way that there will be no play in the connection. Play in the vertical direction Y can be avoided if the projections 168 do not completely bottom out in the indentations 130.

As shown in FIG. 7, two paired-snap construction elements 100 also have some space between the opposing side surfaces 106 when placed together. There are only a few selected surfaces on the mating connection elements that are actually in contact with each other. This means that the outside dimensions do not have to be as accurate or flat, which is good, as the side surfaces 106 can be slightly curved after molding.

Figure 67:
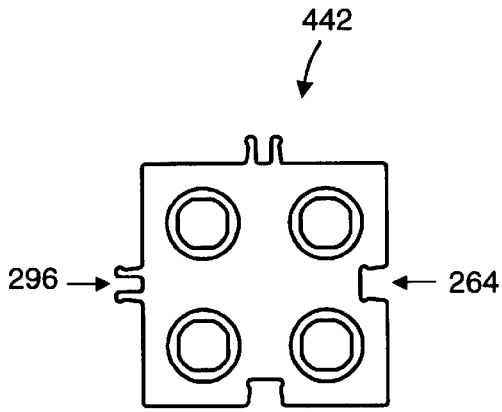
FIGS. 67 and 68 are plan views showing two alternate construction elements with male type one and female type two connection elements.

The male connection element 102 having the depression 142 next to the ribs 126, generally allows the ribs 126 to be longer in the longitudinal direction Z than if they only extended from the side surface 106. An alternate embodiment without this depression 142 is shown in FIG. 67. There are several advantages in using such longer ribs 126 especially when stud type connecting systems are used on the top and bottom surfaces on smaller toy construction sets. FIG. 4 shows that when two paired-snap construction elements 100 are engaged, there is little room between two facing stud walls 110. If the rib 126 would extend directly from the side surface 106, the rib 126 would need to be roughly one-half as long. The male connection element 102, already has a ridge length that is nearly 30% of the total rib length in the longitudinal direction Z. If either the ridge 128 is shorter in the longitudinal direction Z, or lower in the horizontal direction X to reduce the need for bending, or the ribs 126 are thinner in the horizontal direction X to allow for easier bending, problems are experienced. Already the ribs 126 are nearly as thin as the thinnest part on the construction element and making them thinner would result in either molding problems or sharper corners. The ridge 128 being lower in the horizontal direction X is not very practical because of tolerances, and the ridge being shorter in the longitudinal direction Z would wear the groove 154. FIG. 4 shows that the balanced connection element design of the paired-snap construction element 100 results in efficient use of the space between the two opposite facing stud walls 110.

Having all the connection elements molded as part of the construction element has advantages especially for toy construction sets. This way there are no separate connection pieces that can choke a child if swallowed. Less total pieces are required when packaging.

While the paired-snap construction element 100 is in the shape of a square, many other shapes may be made in order to develop a diverse set of construction elements for a multitude of construction sets. For example, FIGS. 19 to 23 illustrate some of the variety of shapes and configurations of construction elements possible using paired-snap connection elements of the invention. A rectangular construction element 242 is not as necessary when using snap-fit connection elements on the side faces as with prior art such as "Lego Classic" 398. An equilateral triangle construction element 244 is a useful construction element especially with paired-snap connection elements because it has connection elements on all sides and can be put together in a solid matrix just like square construction elements. A pie shaped construction element 246 is useful for constructing circular shapes. A right isosceles triangle construction element 248 can be used for mitered corners. A beam construction element 249 has no snap-fit connection elements on its sides and some embodiments may not use stud type connections on the top surface.

It is also contemplated that different construction elements will have different numbers and patterns of male and female connection elements per side as discussed in the following section.

DESCRIPTION—FIGS. 24–30—SINGLE-SNAP

Figure 24:
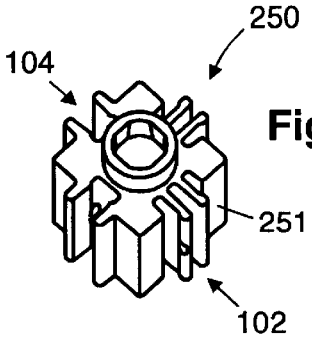
FIG. 24 is a perspective view of an alternate embodiment "single-snap" construction element showing single-snap connection elements on faces.
Figure 25:
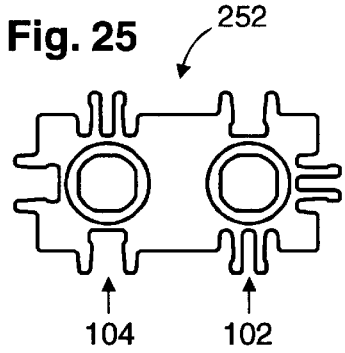
FIGS. 25 to 29 show plan views of some of the different shapes of construction elements possible with the single-snap connection element of FIG. 24.
Figure 29:
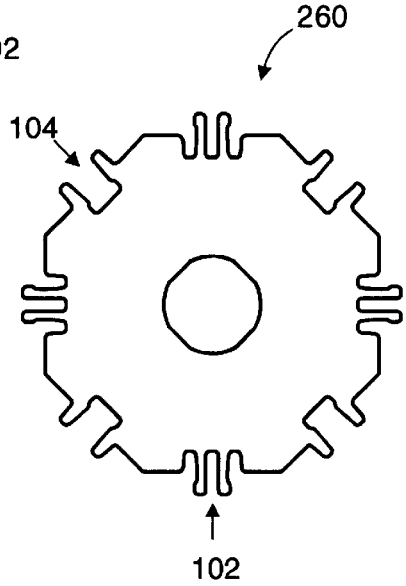
Figure 26:
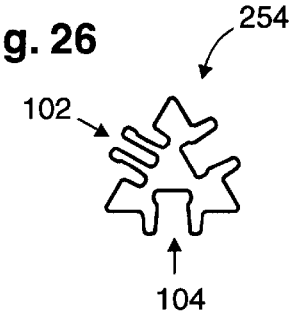

An alternate embodiment of the invention is a single-snap construction element 250 as shown in FIG. 24. The male connection element 102 and female connection element 104 used are identical to those of the paired-snap construction element 100, only here a minimum of one snap-fit connection element is used on each side. Having only one connection element per side has some disadvantages over using paired snap-fit connection elements, but there can be several reasons for doing so. For example, the single-snap construction element 250 shown can be a small construction element to be used together with the larger paired-snap construction element 100. If the length of each side of the single-snap construction element 250 is one-half that of the larger paired-snap construction element 100, it would be compatible. If the same studs are used, this makes the design even more complimentary than prior art designs such as "Lego Duplo" 396 and "Lego Classic" 398 which use different sized studs for a reason. Because "Lego Duplo" 396 and "Lego Classic" 398 do not have side connection elements, the construction elements must be staggered overtop of each other to build sideways. A minimum of 2 stud rows is then a minimum. Construction elements with connection elements on the sides do not have this limitation and can more practically be made using single rows of studs. The single-snap construction element 250 could be also made one-half the height of paired-snap construction element 100 for example, but this might result in an imperfect match with the indentations 130 and the projections 168 in some situations. Using the same indentation 130 and projection 168 dimensions for both the paired-snap construction element 100 and single-snap construction element 250 would at least allow them to be properly engaged at mid height.

Just as with the previous paired-snap design, many other shapes may be made in order to develop a diverse set of construction elements. FIGS. 25 to 30 illustrate a variety of shapes and configurations of construction elements using single-snap connection elements of the invention. A rectangular construction element 252 is now a more practical construction element than the square one. An equilateral triangle construction element 254 is now not as useful a construction element because it cannot be made into a solid matrix. A pie shaped construction element 256 is still useful for constructing circular shapes. A right isosceles triangle construction element 258 can still be used for mitered corners. A six-sided polygon construction element 260 could be used for a type of radial construction system. A beam construction element 262 with single-snap connection elements on each end could be made quite narrow.

In the paired-snap construction element 100, the contact points between engaged construction elements were preferably only in the connection area. This would result in an undesirable amount of movement with the single-snap construction element 250 and so it would be better to have very little clearance between a side surface 251 when two construction elements are engaged. Because the side surface 251 is much less in area than that of the paired-snap construction element 100, this is not as big a disadvantage. It is also contemplated that there would be various other combinations of this design.

DESCRIPTION—FIG. 31—SPLIT-SNAP

Figure 31:
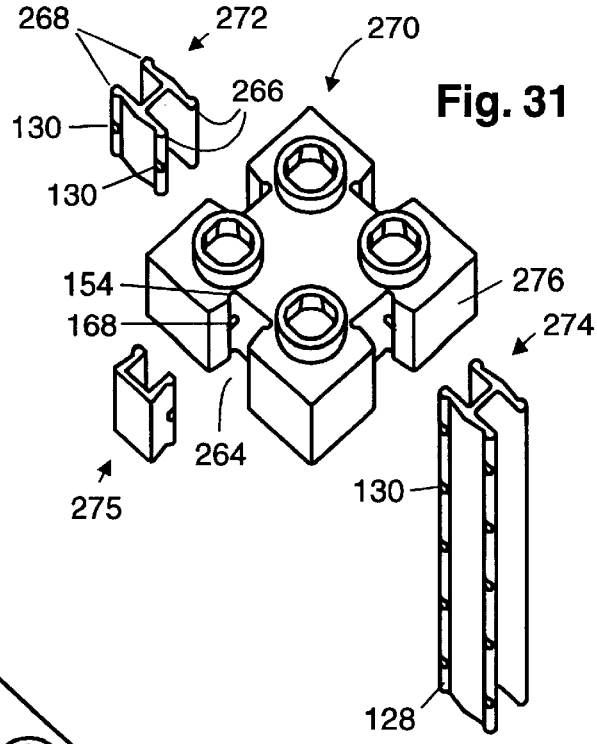
FIG. 31 is a perspective view of an alternate embodiment "split-snap" construction element.

Another alternate embodiment of the invention is a split-snap construction element 270, as illustrated in FIG. 31, which does not contain male connection elements. Only a female type two split-snap connection element 264 is used, which is identical to the female connection element 104 except that it doesn't have anti-twist bars 162 and is fully sunken below the side surface 276. The female split-snap connection element 264 contains the same grooves 154 and projections 168 of the paired-snap construction element 100.

The male type one connection element is now part of a short split-snap construction element 272 or a long split-snap construction element 274, primarily consisting of a pair of side A ribs 266 and another pair of side B ribs 268 which are opposed to the first pair and preferably all of equal length. These are basically double-sided versions of the male connection element 102 of the paired-snap construction element 100 without the depressions 142 and contains the same ridges 128 and the indentations 130. When two split-snap construction elements 270 are engaged together they would ideally touch together on a side surfaces 276.

One of the advantages of the paired-snap construction element 100 and the single-snap construction element 250, shown in FIGS. 1 and 24 respectively, is that the connection elements are captive on a generally larger construction element. When used for toys with construction elements of sufficient size, this prevents children from swallowing and choking on tiny construction elements. Perhaps this would make the split-snap construction element 270 less desirable for small toys, but it would be quite ideal for larger construction systems. The split-snap construction element 270 has the advantage that there are no connection elements protruding unnecessarily from the sides of constructions. A filler construction element 275 can be inserted to make the split-snap construction element 270 flush on the sides. The split-snap construction element 270 does not really require stud walls 110 because the long split-snap construction element 274 can be used to fasten split-snap construction elements 270 above and below as well as on sides. The long split-snap construction element 274 ideally would contain multiple indentations 130 along its length to match those of multiple vertically stacked split-snap construction elements 270. Because the long split-snap construction element 274 contains flexible members, it could still be produced with an inexpensive molding process similar to what would be used to produce the paired-snap construction element 100.

While the split-snap construction element 270 shown is in the shape of a block, the same details can be used to produce new construction elements such as beam, radial-hub, strut, flexible rod, wire, and panel construction elements.

DESCRIPTION—FIGS. 32–33—BEAMS

Figure 33:
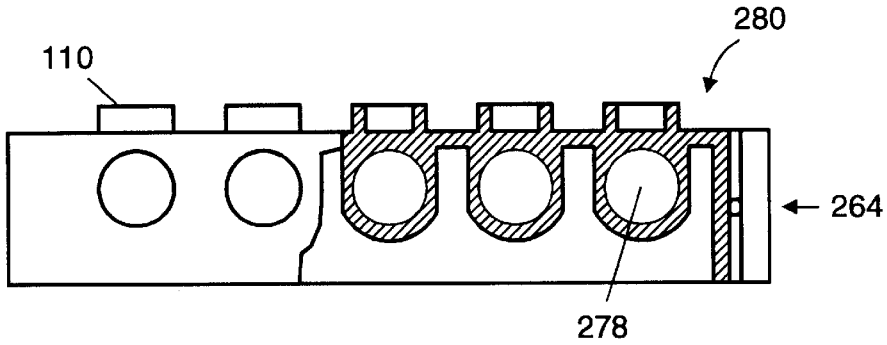
FIGS. 32 and 33 are perspective and partial sectional views respectively of an alternate embodiment "beam" construction element incorporating the split-snap design.
Figure 32:
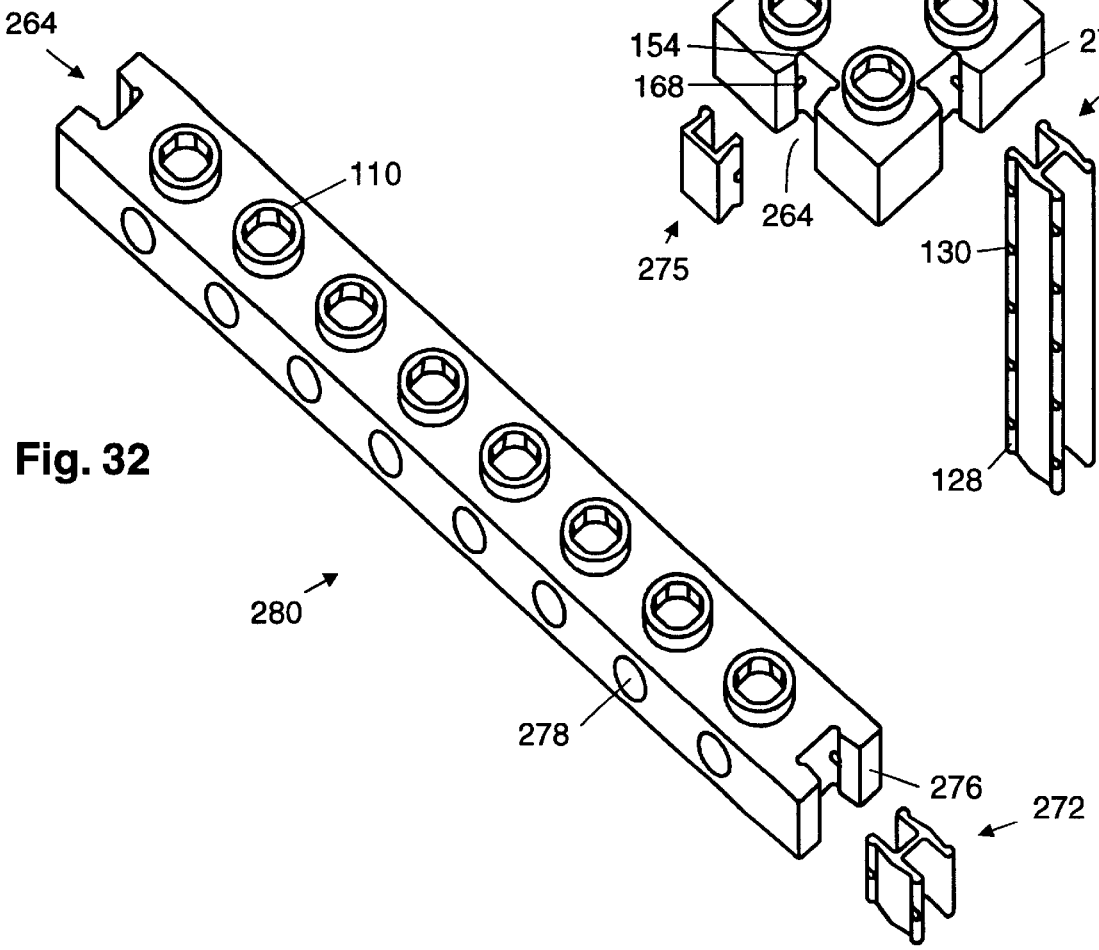

Another alternate embodiment of the invention is a beam construction element 280, as is shown in FIG. 32, which has no snap-fit or stud type connection elements on one pair of sides, but rather uses a beam hole 278. Such beam holes 278 have been used for example on the "Lego Technic" series for some time and can be used to connect a variety of construction elements together or the beam holes 278 can be used as bearings for shafts. FIG. 33 shows details of where the beam holes 278 would ideally be located, which would be underneath each stud wall 110.

On each end of the beam construction element 280, female split-snap connection elements 264 would be used. The beams would be fastened together with the short split-snap construction element 272. The ends of the beam construction element 280 would touch each other on the side surfaces 276. Tests have shown that such a connection, even with the narrow bearing area of the side surface 276, can result in a very tight connection and fairly long overhanging spans are possible.

DESCRIPTION—FIGS. 34–37—RADIAL-HUBS

Figure 34:
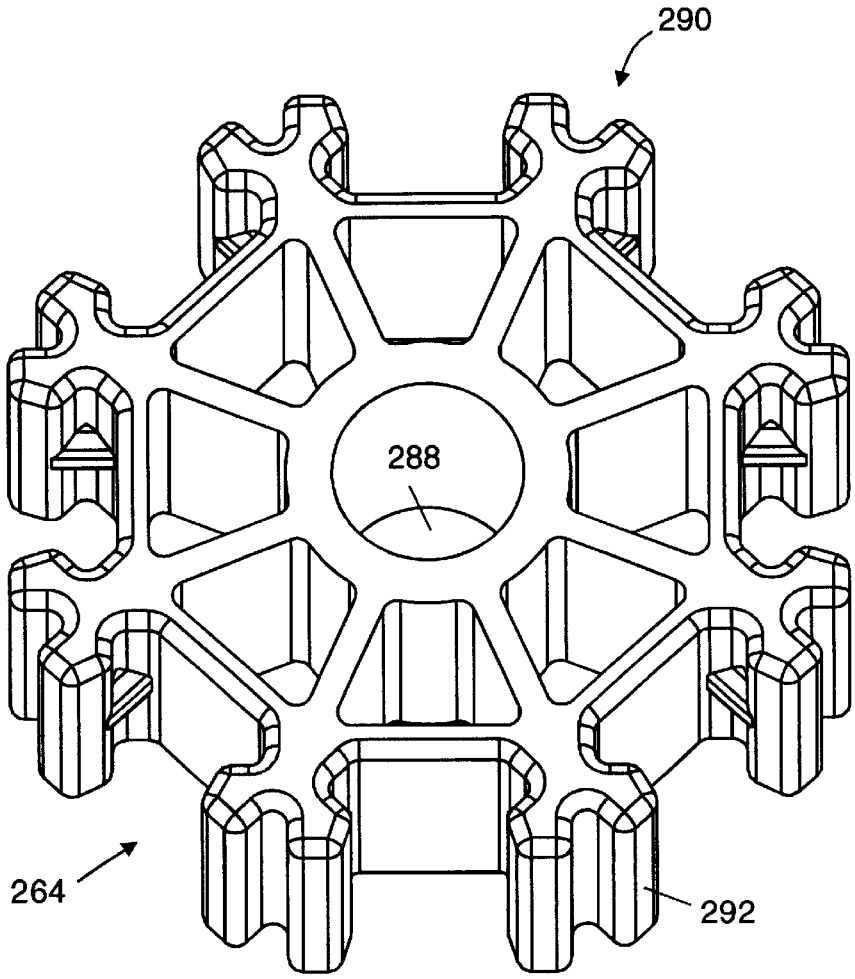
FIGS. 34 to 37 show a perspective view and plan views respectively of an alternate embodiment "radial-hub" construction element with female type two connection elements.

Another alternate embodiment of the invention is a radial-hub construction element 290 shown in FIG. 34 which can be used together with other construction elements such as the strut, rod, and wire construction elements shown later. Actually the radial-hub construction element 290 is like the split-snap construction element 270 but with a more open molded structure and uses the same female split-snap connection element 264. The radial-hub construction element 290 has eight female split-snap connection elements 264 arranged at 45 degree increments. The radial-hub construction element 290 also contains a hole 288 at the center point of the radial arrangement. With the right dimensions, the radial-hub construction element 290 could be made to connect directly to the split-snap construction element 270 and beam construction element 280. Alternately the radial-hub construction element 290 could contain the male connection elements and the strut, rod, and wire construction elements could contain the female connection elements. This however would result in a less than optimum system.

One advantage of the radial-hub construction element 290, like the other construction elements just described, is that the various construction elements that connect to it can be inserted and taken apart in many directions. The hole 288 in the radial-hub construction element 290 can be used for a variety of purposes. Rods can be inserted through the hole 288 or it can be used to adapt directly to other construction systems. The radial-hub construction element 290 could be used used with for example the paired-snap construction element 100 by using a plate adaptor as shown in FIGS. 46 to 49.

Figure 35:
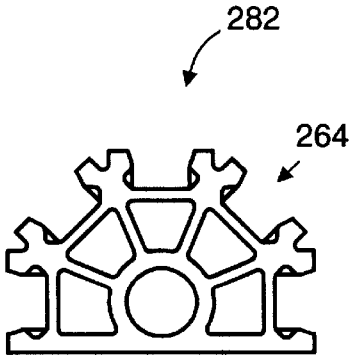
Figure 36:
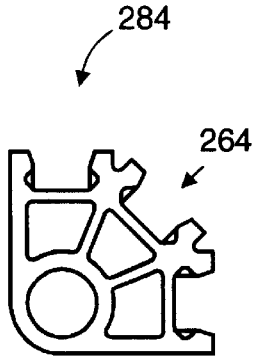
Figure 37:
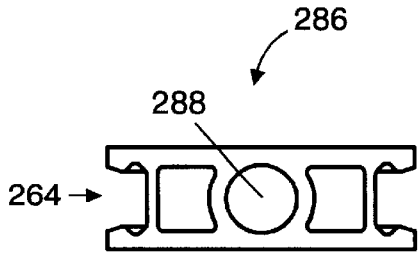

FIGS. 35 to 37 show some of the other radial-hub construction elements possible such as a 180 degree radial-hub construction element 282, a 90 degree radial-hub construction element 284, and a straight radial-hub construction element 286. Other designs with a solid top surface, or a solid middle surface at the vertical half point would function just as well.

DESCRIPTION—FIGS. 38–40—STRUT, ROD, WIRE

Figure 38:
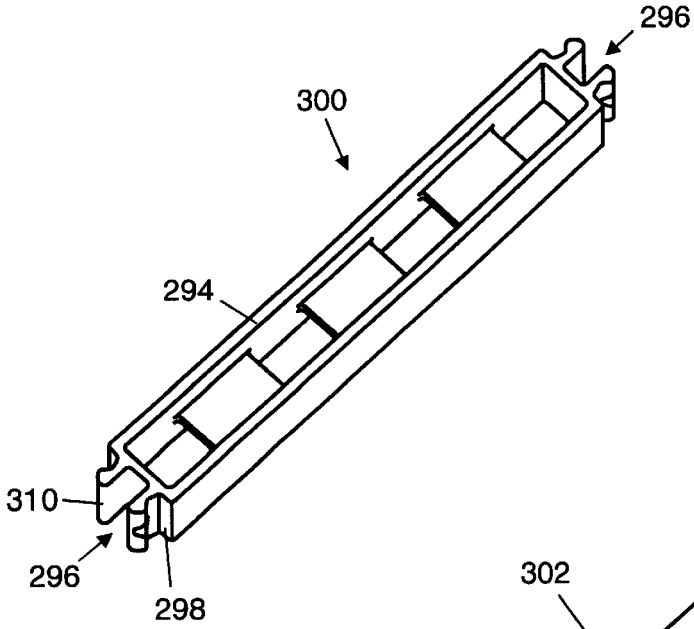
FIG. 38 is a perspective view of an alternate embodiment "strut" construction element.

Another alternate embodiment of the invention is a strut construction element 300 as shown in FIG. 38. A male type one split-snap connection element 296 having a pair of ribs 310 and containing a side surface 298, is attached to the end of a strut body 294. The strut body 294 is shown with a hollow or U-section shape however other configurations could be used. The male split-snap connection element 296 is a new variation of snap-fit connection element which is basically one-half of the short split-snap connection element 272. The male split-snap connection element 296 uses the same ridge 128 and the indentation 130. The male split-snap connection element 296 would ideally use slightly shorter and stiffer ribs than some previously mentioned designs due to the short length in the vertical direction Y of the ribs 310, the small side surface 298, and the long length of the strut body 294 compared to its width. Like the beam construction element 280, the joint rigidity relies on the ridge ramp 132 pulling the side surface 298 against a side surface 292 of the radial-hub construction element 290. Struts are often used to build space-frame type of structures and are designed to be reasonably stiff.

Figure 39:
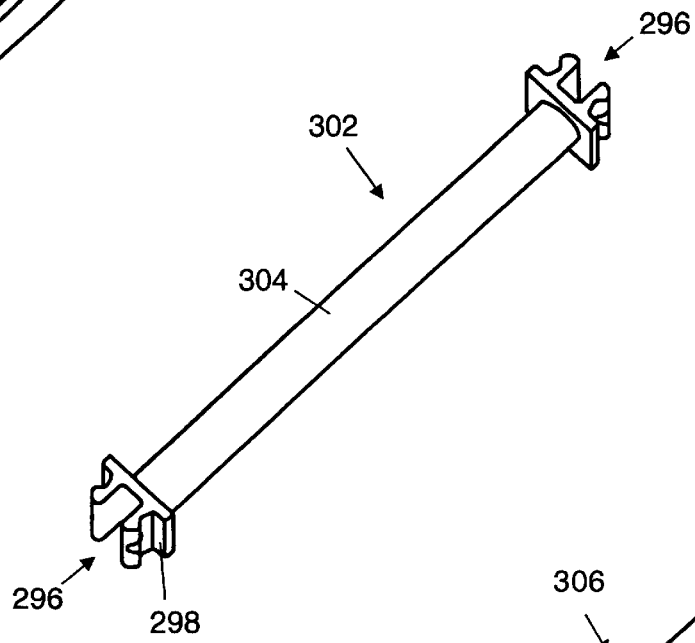
FIG. 39 is a perspective view of an alternate embodiment "rod" construction element.

Another alternate embodiment of the invention is a rod construction element 302 as shown in FIG. 39. It would use the male split-snap connection element 296 and a flexible rod body 304. Such a construction element could be snapped onto various construction elements to produce imaginative designs with multiple arcing shapes.

Figure 40:
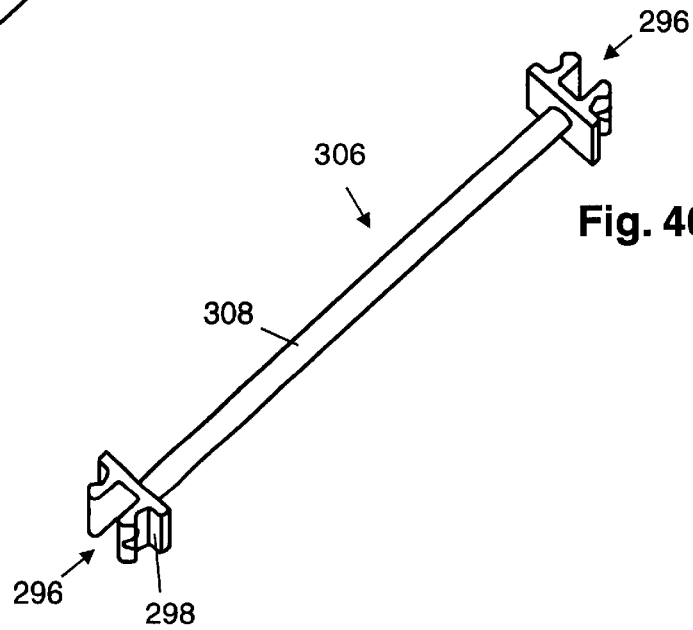
FIG. 40 is a perspective view of an alternate embodiment "wire" construction element.

Another alternate embodiment of the invention is a wire construction element 306 as shown in FIG. 40. It would be identical to the rod construction element 302 but instead of a rod body 304, a much narrower flexible wire body 308 would be used. Such a construction element would be useful in constructing structures that use cables such as toy suspension bridges.

DESCRIPTION—FIGS. 42–44—PANELS

Figure 41:
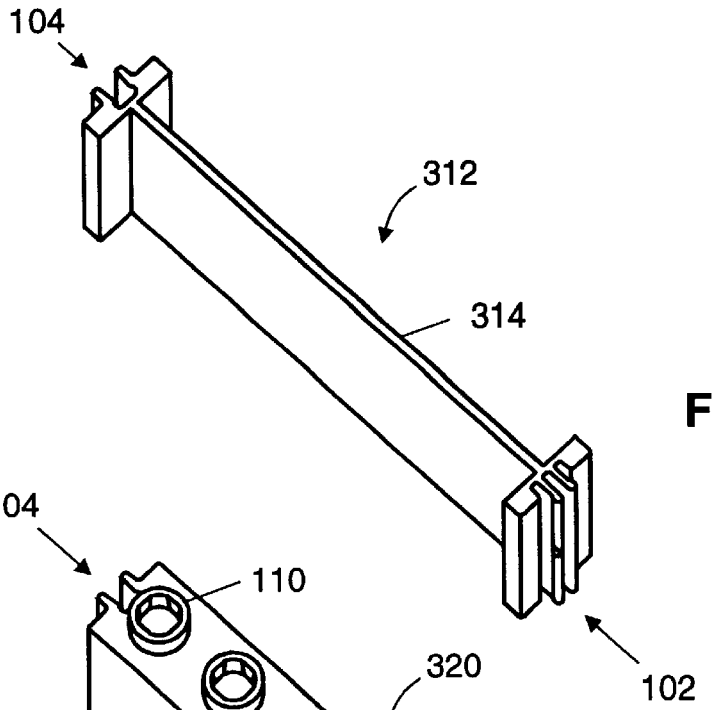
FIGS. 41 to 43 are three perspective views of an alternate embodiment "panel" construction element.

Another alternate embodiment of the invention is a panel one construction element 312, illustrated in FIG. 41. A thin sheet 314 is used as the panel. The male connection element 102 and the female connection element 104 used are identical to that shown in FIG. 1. The height in the vertical direction Y of all panel construction elements would ideally be the same as the paired-snap construction element 100, which would allow panel construction elements to be engaged directly to the block shaped paired-snap construction element 100 and also the single-snap construction element 250. Taller panels might be more desirable, however the shorter panel construction elements are easier to mold and are more modular than taller panel construction elements especially for toy construction systems.

Figure 30:
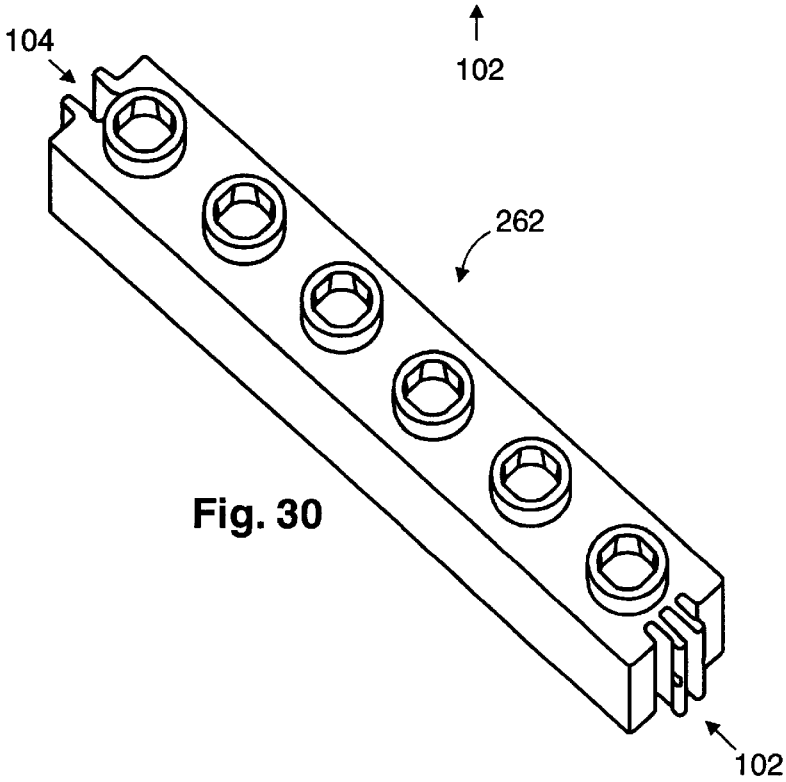
FIG. 30 is a perspective view of an alternate embodiment "beam" construction element incorporating the single-snap connection element of FIG. 24.
Figure 27:
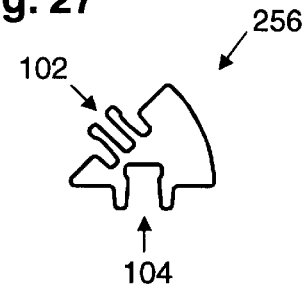
Figure 28:
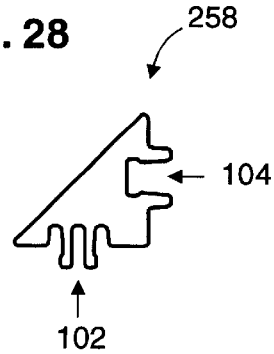
Figure 42:
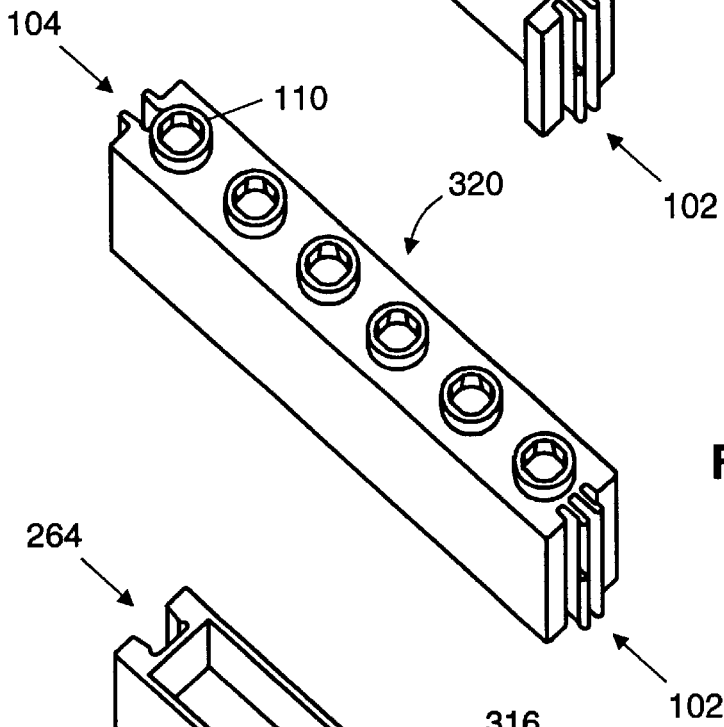

Another alternate embodiment of the invention is a panel two construction element 320, illustrated in FIG. 42. This type of panel element can be considered a variation of the beam construction element as shown in FIG. 30 except it would be generally taller. The panel two construction element 320 is hollow and uses the same stud wall 110 as the paired-snap construction element 100. It also uses the same male connection element 102 and the female connection element 104 as shown in FIG. 1. The stud walls 110 allow the panel two construction elements 320 to be assembled to other panel two construction elements 320 without mating to block style construction elements on the sides.

Figure 43:
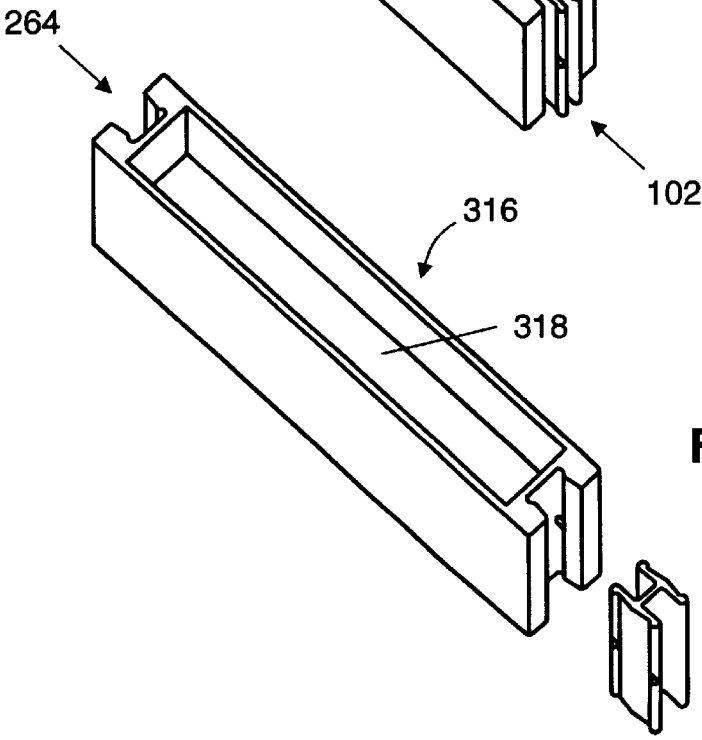

Another alternate embodiment of the invention is a panel three construction element 316, illustrated in FIG. 43. A hollow type cross section is used which has a horizontal divider 318 to stabilize the walls. The panel three construction element 316 is a variation of the split-snap construction element 270 which is shown in FIG. 31, and uses female split-snap connection elements 264 on each edge. Long split-snap construction elements 274 or alternatively the short split-snap construction elements 272 could be used to connect the panel three construction elements 316 together at the edges. The advantage of this system is that many panels can be engaged side-by-side without requiring any block construction elements. Also the long split-snap construction elements 274 would not be visible once assembled.

Figure 44:
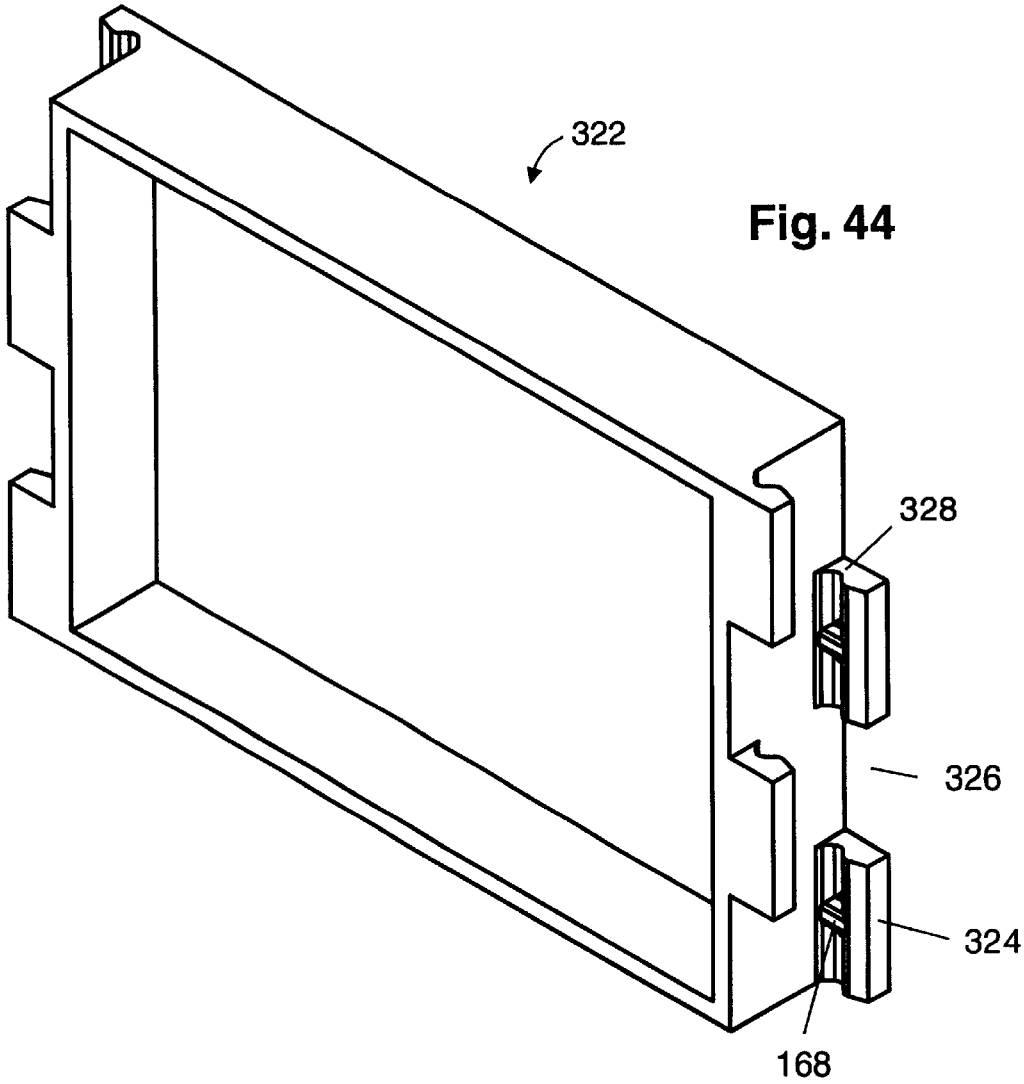
FIG. 44 is a perspective view of a further alternate embodiment panel construction element.

Another alternate embodiment of the invention is a panel four construction element 322, illustrated in FIG. 44. This panel four construction element 322 is similar to the panel three construction element 316 and the split-snap construction element 270. Instead of using a continuous female split-snap connection element 264, a female type two panel tab 324 with a series of gaps 326 between panel tabs 324 is used instead. This allows the tall panel four construction element 322 to be molded in a more optimum direction where the draw of the mold would now be perpendicular to the large faces of the panel. The gaps 326 are interspersed between each of the panel tabs 324, such that where the gap 326 occurs, there is no panel tab 324 in the horizontal direction X. Each panel tab 324 has a groove 328 and projection 168. Long split-snap construction element 274 could be used to connect the panel four construction element 322 edge to edge with panel tabs 324 touching each other. The gaps 326 however would be visible and so this method may be more ideal for toy sets. Ideally the panel four construction element 322 could be engaged to block walls made of the split-snap construction elements 270. In this case, each panel tab 324 should correspond to the height of one split-snap construction element 270. Using long split-snap construction elements 274 would enable the panel four construction element 322 to be engaged to each other or to posts or blocks. Ideally the projections 168 would be centrally located on the panel tab 324 to mate with the indentations 130 in the long split-snap construction element 274.

Another alternate embodiment of the invention is a panel five construction element, not shown, which would use staggered male type one panel tabs with outward facing ridges. Now the panel is really a variation of the long split-snap construction element 274 which could be engaged together with variations of the split-snap construction element 270.

Tall variations of some of the panel construction elements mentioned could be manufactured by a variety of processes such as extruding or machining but these processes might require specialized machinery to be able to create the indentations 130 or the projections 168 during the machining operation.

DESCRIPTION—FIGS. 45–49—PLATES

Figure 45:
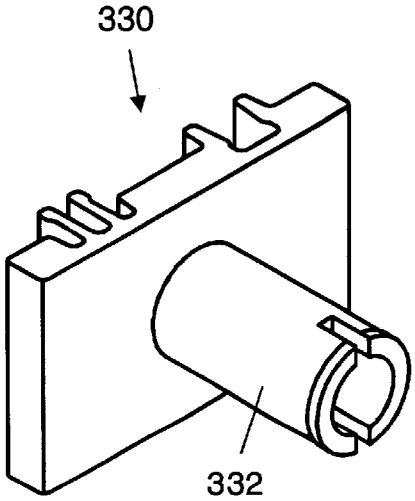
FIGS. 45 to 49 are perspective views of an alternate embodiment "plate" construction element with various adaptors and elements attached.

Another alternate embodiment of the invention is a plate construction element which is essentially one side wall of the paired-snap construction element 100 or the single-snap construction element 250. Such a plate construction element could be engaged onto the sides of regular construction elements such as the paired-snap construction element 100. The plates could contain features attached or molded on to them. A stud plate construction element 330 is shown in FIG. 45. A stud 332 in the form of a split snap-pin, which is known in the art, could be used to connect wheels or other accessories onto construction elements.

Figure 46:
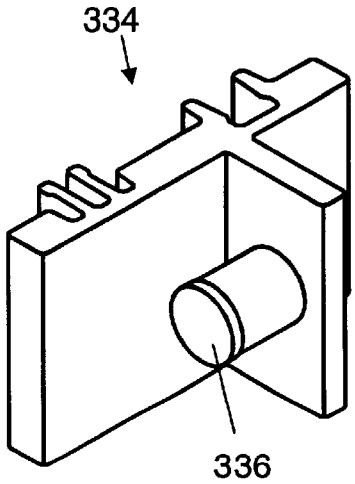

Another alternate embodiment of the invention is a side-pin plate construction element 334, which has a side pin 336 as shown in FIG. 46. This side pin 336 could be used to connect the radial-hub construction element 290 to the paired-snap construction element 100 or to connect to components of other construction sets such as "K'nex" or "Znap".

Figure 47:
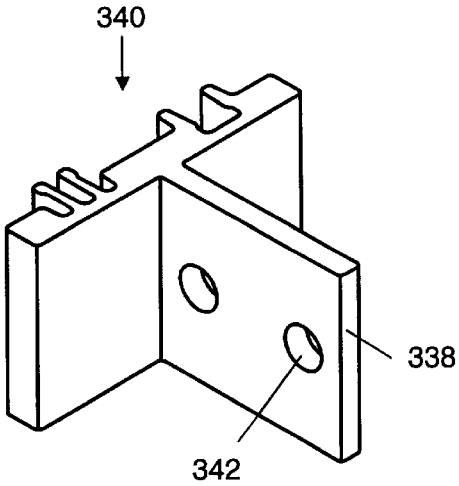

Another alternate embodiment of the invention is a tab plate construction element 340, which uses a protruding plate 338 containing a plurality of holes 342 as shown in FIG. 47. The plate 338 and the holes 342 could be used to connect to a variety of plates and fittings of other construction sets such as "Mechano".

Figure 48:
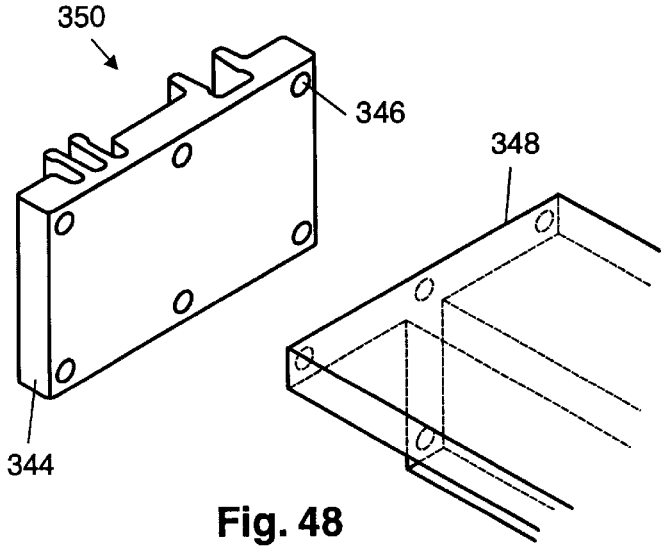

Another alternate embodiment of the invention is a split plate construction element 350, shown in FIG. 48. A plate 344 with a plurality of holes 346 can be permanently attached to a variety of construction parts such as a floor panel 348, beams, cabinets, or shelving, using screws or for example by welding or gluing.

Figure 49:
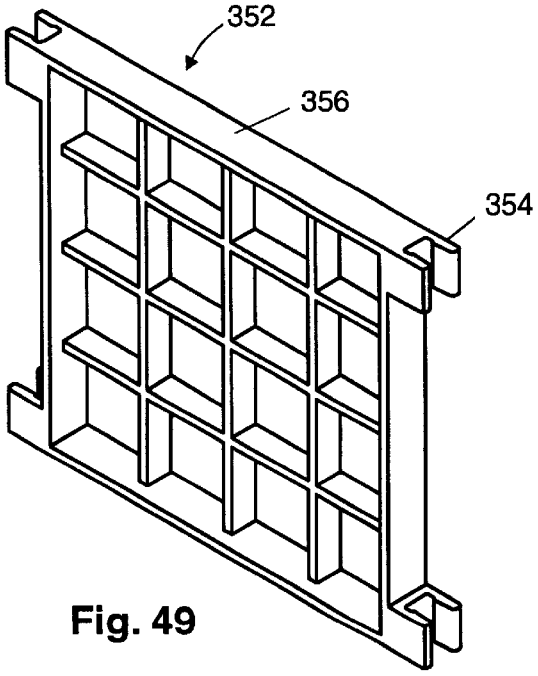

Another alternate embodiment of the invention is a window construction element 352 as is shown in FIG. 49, which uses a series of single-snap plates 354 attached to a window 356.

DESCRIPTION—FIGS. 50–52—WEDGE SPACER

Figure 50:
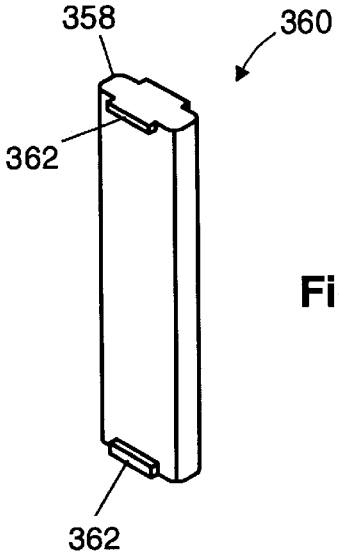
FIGS. 50 to 52 are perspective views of a related embodiment "wedge spacer" construction element.
Figure 51:
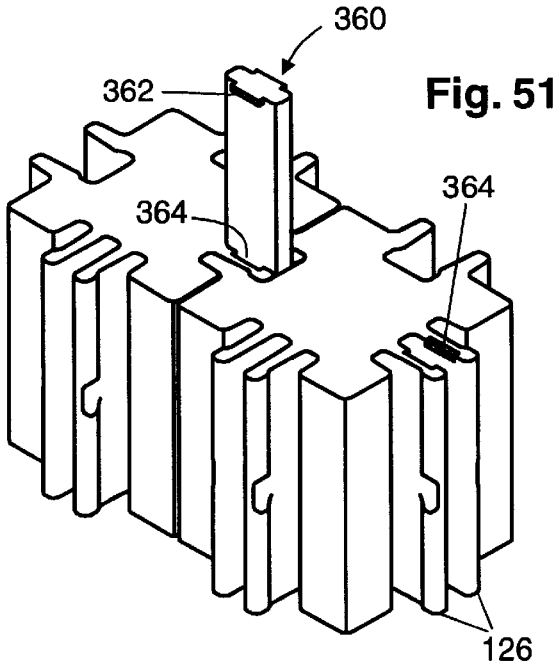
Figure 52:
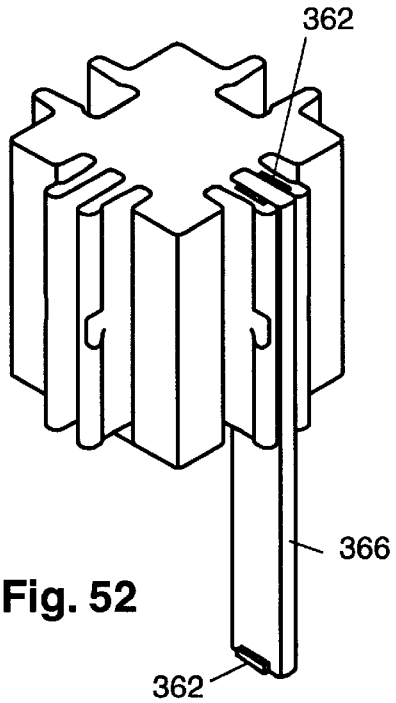

Another embodiment of the invention is a wedge spacer construction element 360, shown in FIGS. 50 to 52, which can be inserted between any male ribs which contain the rib cavity 138. One of the advantages of the basic connection design of the paired-snap construction element 100 is that the male connection element 102 and the female connection element 104 fit neatly into spaces in the other's features. When the paired-snap construction elements 100 have been engaged together, nearly all the space that is left in the connection area is the neat rectangular rib cavity 138 as is shown in FIGS. 4 and 7. The wedge spacer construction element 360 can be inserted into this rib cavity 138 to prevent the ribs 126 from bending inwards, thereby creating a much stronger connection than without.

The wedge spacer construction element 360 can be made of any semi-rigid to rigid material. If it is made of a semi-rigid resilient deformable material, it can provide additional connection strength, but the construction elements can still be taken apart in the normal way. The wedge spacer construction element 360 could be sized so that the friction between its surfaces and those of the rib cavity 138 bounding it are sufficient to prevent any movement after insertion. An alternate way to keep the wedge spacer construction element 360 in position when the construction elements are engaged is by using a protrusion 362 on the ends of the wedge spacer construction element 360 which fits into a rib notch 364 in the insides of the ends of the rib 126. Each end of the wedge spacer construction element 360 should contain a wedge spacer radius 358 to allow for easier insertion into the rib cavity 138. The wedge spacer construction elements 360 used in small toy construction sets ideally would be made of a non-toxic, dissolvable, and even edible material.

A long wedge spacer construction element 366 is shown in FIG. 52. This long wedge spacer construction element 366 can be used to connect construction elements together that are above or below without the need of other types of connection elements on the top and bottom faces.

DESCRIPTION—FIGS. 53–56—ROTATORS

Figure 53:
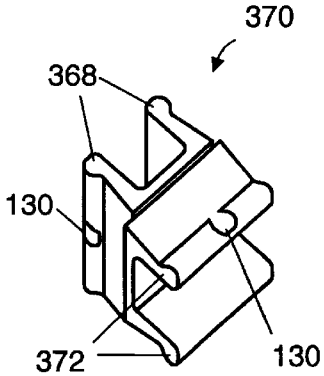

Another alternate embodiment of the invention is a split-snap rotator 370 as shown in FIG. 53. This type of connection element is basically the short split-snap connection element 272 which is split so that a pair of side C ribs 368 and a pair of side D ribs 372 are set at 90 degrees to each other. Any other angle could be used as well. The split-snap rotator 370 may be used to engage construction elements together at various angles to one another and allows construction to proceed at a different angle. The split-snap rotator 370 can be molded in one piece or welded together for larger construction elements.

Figure 54:
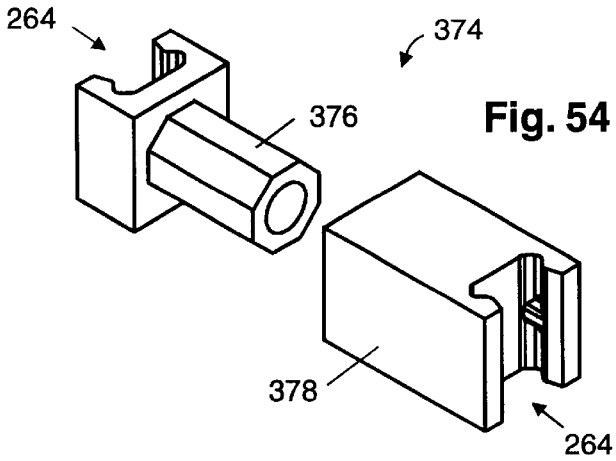

Another alternate embodiment of the invention is an XZ rotator 374 as shown in FIG. 54. The XZ rotator 374 is composed of two parts. A side E 376 contains an eight-sided projection. Any number of sides could be used as well. The side E 376 mates by friction or snap ridges into an eight-sided side F 378. By separating side E 376 and side F 378, they can be rotated at various angles and re-engaged. The XZ rotator 374 shown contains female split-snap connection elements 264, however many different connection elements could be used.

Figure 55:
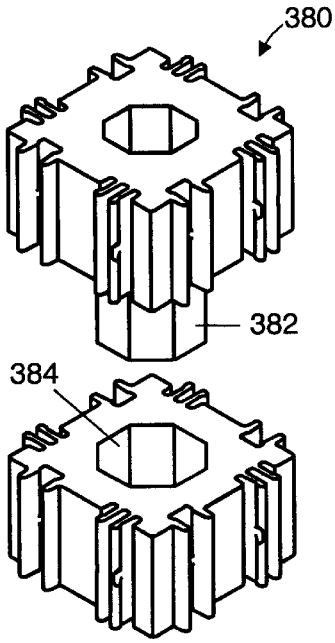
FIGS. 53 to 56 are perspective views of various "rotator" construction elements.

Another alternate embodiment of the invention is a Y rotator 380 as shown in FIG. 55. A side G 382 fits by friction or snap ridges into a side H 384. By separating side G 382 and side H 384, the construction elements can be rotated at various angles and re-engaged.

Figure 56:
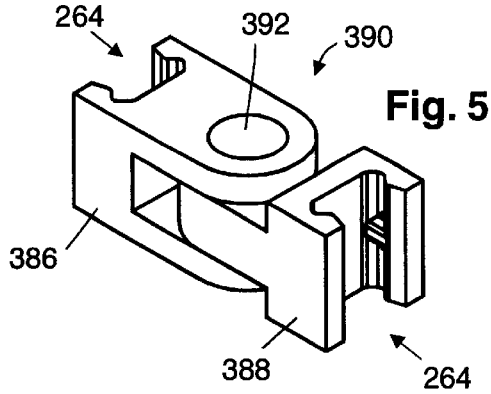

Another alternate embodiment of the invention is a pivot rotator 390 as shown in FIG. 56. A side J 386 is engaged to a side K 388 by a pin 392, which allows the joint to rotate either freely or with some friction. Alternately a knuckle joint or other swivel arrangement could be used.

DESCRIPTION—FIGS. 41–52—OTHER

Figure 57:
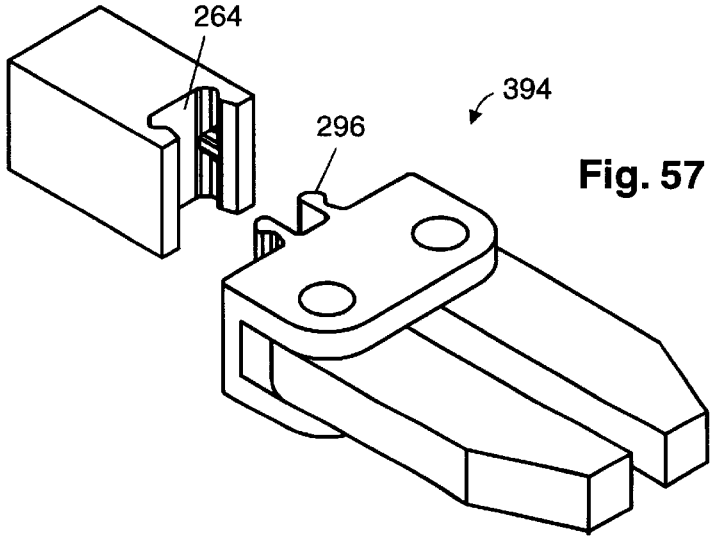
FIG. 57 is a perspective view illustrating how construction elements such as a robot hand can be fastened to each other.

In this section a variety of additional embodiments of the invention are shown. Another alternate embodiment of the invention is a robot hand construction element 394 engaged to a beam or strut construction element for a toy construction set as shown in FIG. 57. A whole variety of other features could be engaged in a similar way.

It has already been mentioned that the paired-snap construction element 100 contains features that allows it to be engaged to other toy construction sets. FIG. 58 shows some of the toy construction systems that can be joined to the paired-snap construction element 100. If the stud wall 110, the inner wall stud contacts 124, and the tubular wall stud contacts 118 are the same dimensions as that of "Lego Duplo" 396, then "Lego Duplo" 396 can be engaged to the top or bottom of paired-snap construction element 100. As well, the stud walls 110 contain the stud cavities 112 that mate with the central tubes of "Lego Classic" 398 and allows "Lego Classic" 398 to be engaged to the top of the paired-snap construction element 100. Some other toy blocks available such as "Morphun" 402 also uses the same stud walls 110 and can be engaged to the top or bottom of paired-snap construction element 100. Toy blocks such as "Kitslink" 404 have a different spacing between studs as "Lego Duplo" 396. A stud adaptor construction element 400 that has "Kitslink" 404 dimensioned cavities below and "Lego Duplo" 396 studs above would allow "Kitslink" 404 blocks to connect onto the bottom of "Lego Duplo" 396 compatible parts. Because the horizontal dimensions of "Kitslink" 404 are not the same as "Lego Duplo" 396, only one stud adaptor construction element 400 would be used to start constructing off in the new "Lego Duplo" compatible system.

Another alternate embodiment of the invention not shown is to use the plate construction elements shown previously in FIGS. 45 to 49 to connect to other construction systems that have side linking connection elements such as "Morphun" 402 and Kitslink" 404. One side of the plate construction element would contain snap-fit connection elements according to the invention and the other would contain dovetail fasteners for the other systems.

Figure 59:
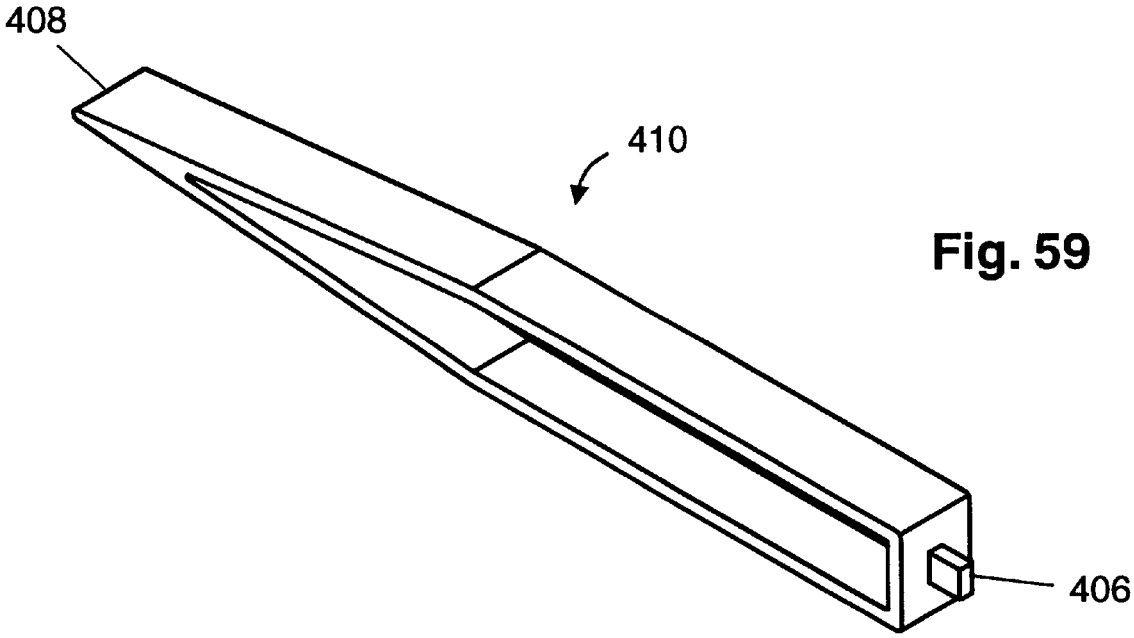
FIG. 59 is a perspective view of a related embodiment "pry tool" that can be used to pry apart layers of construction elements and can also be used to press out wedge spacers.

An additional aspect of the invention is a pry tool 410 as shown in FIG. 59. When a large amount of construction elements such as the paired-snap construction element 100 have been assembled together in a large cubic solid, it can become difficult to pull the paired-snap construction elements 100 apart. The easiest way to split large cubic solids is to pry apart the studs first and peel apart whole layers of the paired-snap construction elements 100. The paired-snap construction element 100 has rounded corners. The pry tool 410 has a pointed end which is designed to help split the paired-snap construction elements 100 apart. The pointed end is rounded with a tip radius 408 to prevent harm to children if used with toy sets, but can still be pushed between the top surface 108 and the bottom surface 114 of the paired-snap construction elements 100. A slight twisting motion along the axis of the pry tool 410 at various places allows whole layers of paired-snap construction elements 100 to be removed. It is now much easier to separate the paired-snap construction elements 100 at the sides. The pry tool 410 also has a wedge spacer punch 406 which can be used to push out or insert the wedge spacer construction element 360.

Figure 60:
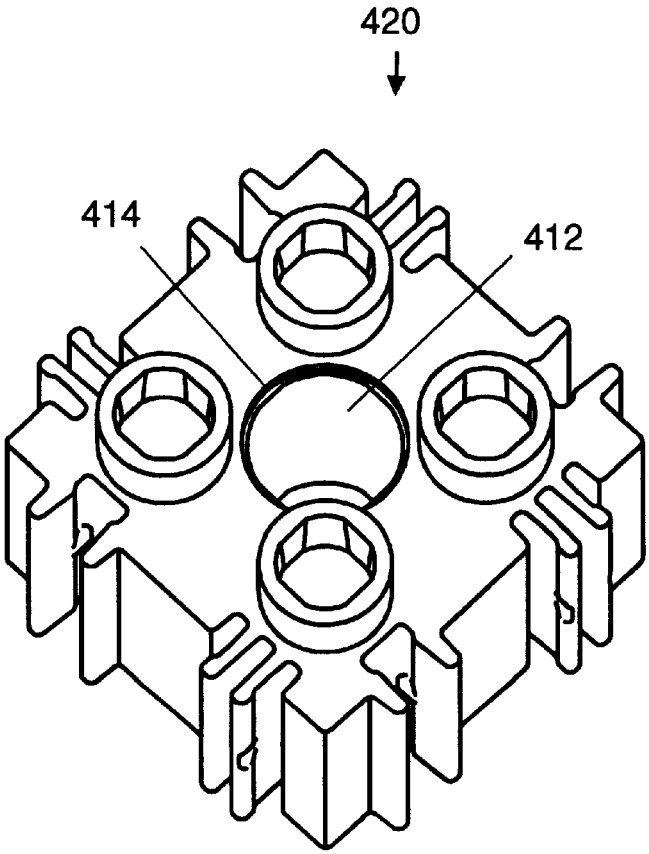
FIG. 60 is a perspective view showing an alternate embodiment "vertical hole" construction element which has a through vertical hole allowing snap-pins and other fasteners to be used to fasten two or more construction elements together in the vertical direction.
Figure 62:
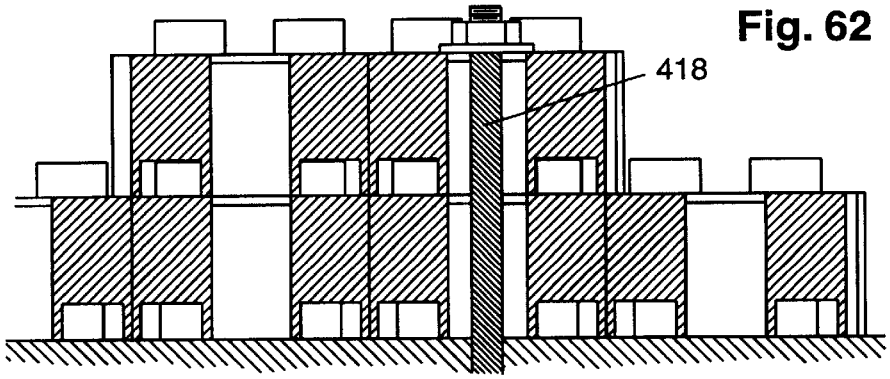
FIGS. 61 and 62 are cross-sectional views on the longitudinal mid-line of several vertical hole construction elements engaged together illustrating how rods and snap-pins can be used to hold blocks together in the vertical direction.
Figure 61:
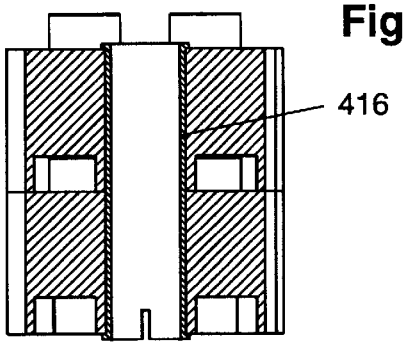

Another alternate embodiment of the invention is a vertical hole construction element 420 as shown in FIG. 60. This construction element would be identical to the paired-snap construction element 100 except that it contains a vertical hole 412 and a countersink 414. The vertical hole 412 would allow a long snap pin 416 or a threaded rod 418 to pass through them as is shown in FIGS. 61 and 62. In toy sets, such long snap pins 416 could anchor two vertical hole construction elements 420 together, as the holding force of the stud connection elements is not very much. In larger construction, the threaded rods 418 could pass through the vertical hole 412 which would allow entire walls to be anchored to the foundation.

Figure 63:
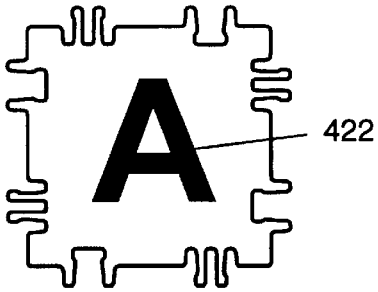
FIG. 63 is a plan view showing an alternate embodiment with a letter on the top face which can be linked together to form words.

The construction elements may be different colors, to allow the creation of multi-colored constructions. When used as an educational toy, construction elements without studs or other connection elements on the top surface and having a letter 422 of the alphabet printed or molded on them could be used, as shown in FIG. 63. Words could be spelled by connecting blocks with different letters together. Similarly, numbers and arithmetic functions could be printed on the blocks in order to teach the fundamentals of math. Alternately, each construction element could contain parts of a picture for a puzzle. Signs could be constructed in the same way, which could easily be changed. It is contemplated that even more educational and commercial uses could be made of the construction elements in this way.

Figure 64:
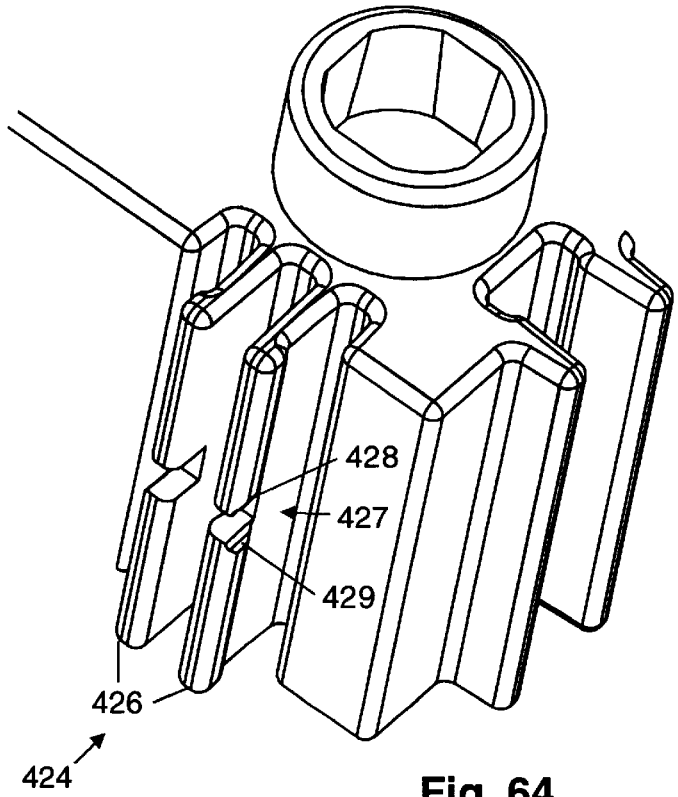
FIG. 64 is a perspective view of an alternate embodiment of the invention where a slot is used in the male type one ribs in place of the usual indentation.

Another alternate embodiment of the invention is a rib with slots 424 as shown in FIG. 64. A slot 427 is used as an alternative to the indentations 130 used on most of the construction elements described so far. The slot also includes an upper slot ramp 428 and a lower slot ramp 429 similar in angle to the indentation 130 of the paired-snap construction element 100. Instead of the slot 427 being only the length in the longitudinal direction Z of the ridges, the slot 427 could extend the full length in the longitudinal direction Z of the ribs 426 which would separate them into two parts.

Figure 65:
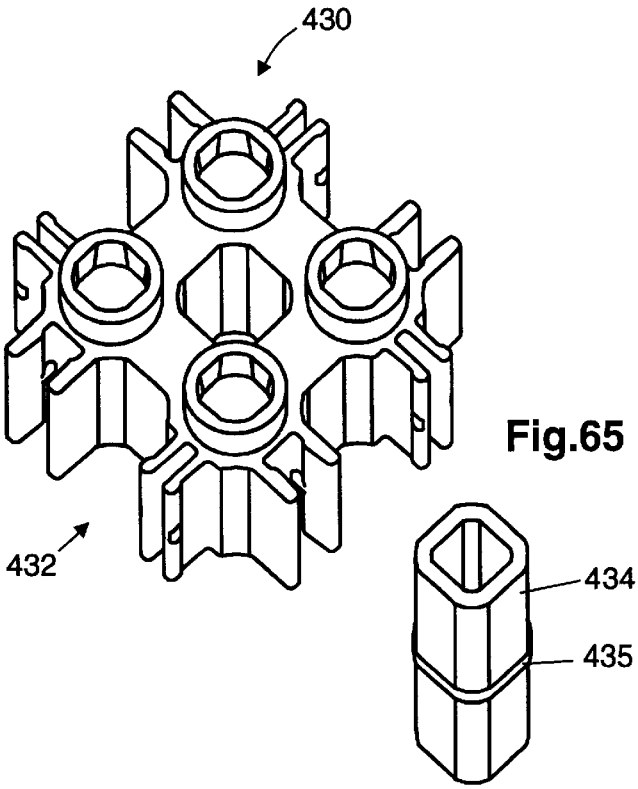
FIG. 65 is a perspective view showing an alternate embodiment of a "channel" construction element with paired-snap fasteners and a ridged tubular column for connecting construction elements together vertically.
Figure 66:
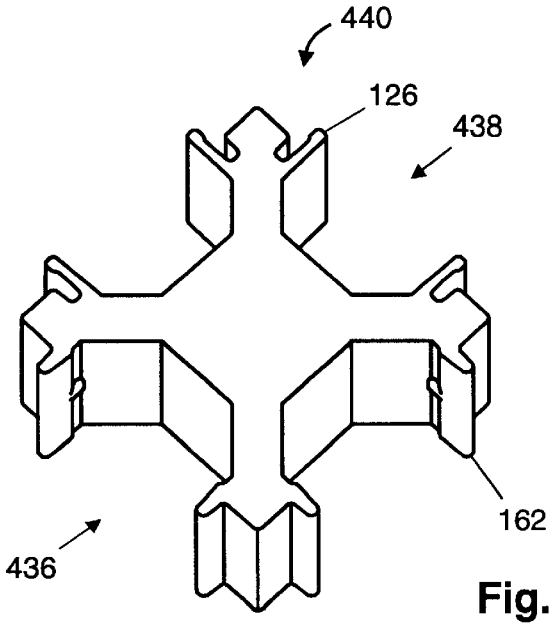
FIG. 66 is a perspective view showing a further embodiment of a channel construction element with single-snap fasteners.

Another embodiment of the invention is the paired-snap channel construction element 430 shown in FIG. 65. The paired-snap channel construction element 430 is identical to the paired-snap construction element 100 of FIG. 1, except that while the sides of the paired-snap construction element of 100 are flat between the connection elements, the sides of the paired-snap channel construction element 430 have a channel 432. When two or more paired-snap channel construction elements 430 are engaged together on the sides, the channels 432 placed together become symmetrical apertures. Two paired-snap channel construction elements 430 could be engaged together around a tubular column 434. If grooves or ledges are provided in the channels 432, they could interact with a ridge 435 of the tubular column 434 to keep the paired-snap channel construction elements 430 from sliding down the length of the tubular column 434. A second variation of this is a single-snap channel construction element 440, shown in FIG. 66, which uses a single-snap connection element on each face rather than paired-snap connection elements. A pair of ribs 438, are essentially like those of the single-snap construction element 250, except the rib cavity consists of a channel 436 which is very wide.

Another alternate embodiment of the invention is a construction element 442 shown in FIG. 67. This design is somewhat similar to the single-snap construction element 250 in that it only has one connection element on each side, but it is different because it has no anti-twist bars 162 or depressions 142. This construction element 442 is really a block embodiment of the radial-hub construction element 290 and the strut construction element 300, and uses the same female split-snap connection elements 264 and male split-snap connection elements 296. Paired-snap connection elements could also be used with this configuration, however there is a limited amount of room between the stud walls 110.

Figure 68:
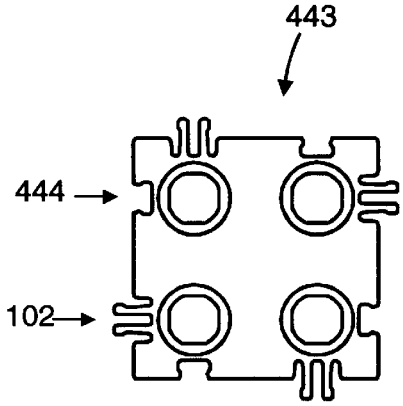

Another alternate embodiment of the invention is a construction element 443 shown in FIG. 68. This construction element 443 is identical to the paired-snap construction element 100 but is missing the anti-twist bars 162. A connection element 444 only extends to the side surfaces of the construction element. This design of construction element might be considered to be slightly easier to assemble than the paired-snap construction element 100, but not having anti-twist bars 162 results in a lot more stress being placed on the extended ribs 126. This is especially a problem if a single connection element is used per side. It is also difficult to provide a female recess that is sufficiently divergent as is illustrated by the example shown in FIG. 12B. The ends of the ribs must have more of a taper, which can result in a longer rib. Also the depressions 142 of the male connection element 102 are not filled up when two construction elements are engaged together and this results in a less appealing look.

DESCRIPTION—CONCLUSIONS, RAMIFICATIONS, SCOPE

The advantages of the snap-fit connection, compared to the usual dovetail connection, is best understood by looking at FIG. 69. This shows a basic male type one snap-fit connection element 446 superimposed over a female dovetail connection element 448. Such a snap-fit connection element 446 could be much the same size as the dovetail connection element 448. With most materials, if the female dovetail connection element 448 was separated from the male dovetail connection element, the narrowed opening of the female dovetail connection element 448 would need to stretch so far that the joint would be damaged. Compare this to the ribs of the snap-fit connection element 446, which can still hold quite tightly at first, but when excessive force is encountered, the male snap-fit connection element 446 could break away from the female connection element, without being damaged. It is also easier to design the snap-fit connection 446 with a higher angle of contact that adds to its holding power. For weaker materials, a dovetail connection spreads the load over a wider area, but with materials such as plastics, the snap-fit connection is a better choice. Dovetail connections are often used because they are simple shapes while snap-fit connections are considered more exotic mechanisms that need much more careful design.

Another advantage of the snap-fit connection system of the invention is that while it can secure a connection in six spatial directions, can be made to engage and separate in many directions, is easy to assemble, can be used to build in many directions, and can be applied to a very wide variety of construction elements, the basic embodiments of the invention can still be produced in the most inexpensive type of single direction mold with only one fixed and one moving die and a simple ejection system. On the paired-snap construction element 100, the ribs 126 contain indentations 130 which are a problem on single direction molds because the corresponding projections in the mold would be in the way of the ribs 126 sliding out of the mold. If side cores would be used, this could result in 32 side cores being needed for an 8-cavity mold. The advantage of the invention is that cores that form the rib cavity 138 between the pair of ribs 126, can be fastened to the moving half of a two-part mold.

In the preferred molding method, the moving half of the mold only contains features to mold the top of the paired-snap construction element 100 and not the snap-fit connection elements on the sides. When this moving half of the mold moves away from the fixed half of the mold, it pulls out the cores. This allows the ribs 126 to flex into this space that now exists between the pair of ribs 126 during the part ejection. The ribs 126 can now temporarily bend and pass over the projections in the mold.

It is contemplated that various embodiments of the invention could be made of various materials and manufactured by various methods. Smaller construction elements would preferably be molded of a plastic material. In the case where the ribs 126 are a permanent part of the construction element, such as the paired-snap construction element 100, it is usually necessary to make the entire construction element of a flexible material. Other construction elements such as the split-snap construction element 270 could be made of a rigid material because the short split-snap construction element 272 or long split-snap construction element 274 can be made of a different and more flexible material. So, such construction elements as the split-snap construction element 270 could also be made of materials such as wood, metal, concrete, and ceramics. Preferably, the different mating material will have a reasonably low coefficient of friction or could be coated or penetrated with a suitable material to reduce the friction.

With toy construction elements, it was found that a lubricant added to plastics such as polypropylene made the construction elements much easier to assemble. The lubricant used in toy construction elements so far has been a lubricant called Erucamide, which is basically of the Fatty Acidamide chemical family derived from cattle beef tallow. This is a relatively inexpensive lubricant, has a long life, and is also considered safe for children to touch or put in their mouths. Acetal, it was found, had a low enough coefficient of friction in its native form, but this material is considerably more costly and shatters more easily than polypropylene.

The versatility of the type one and type two connection elements of the invention means that it can be used with a multitude of construction elements of varying size and shape. It is contemplated that smaller construction elements for use in toy construction sets will be one of the uses of the invention. These may be sold as various construction sets. However, larger construction elements for use in the construction industry could be produced. The construction elements would be useful in a variety of fields such as, construction, toys, educational, machinery, products, jigs, two and three dimensional art, and signs.

Figure 12:
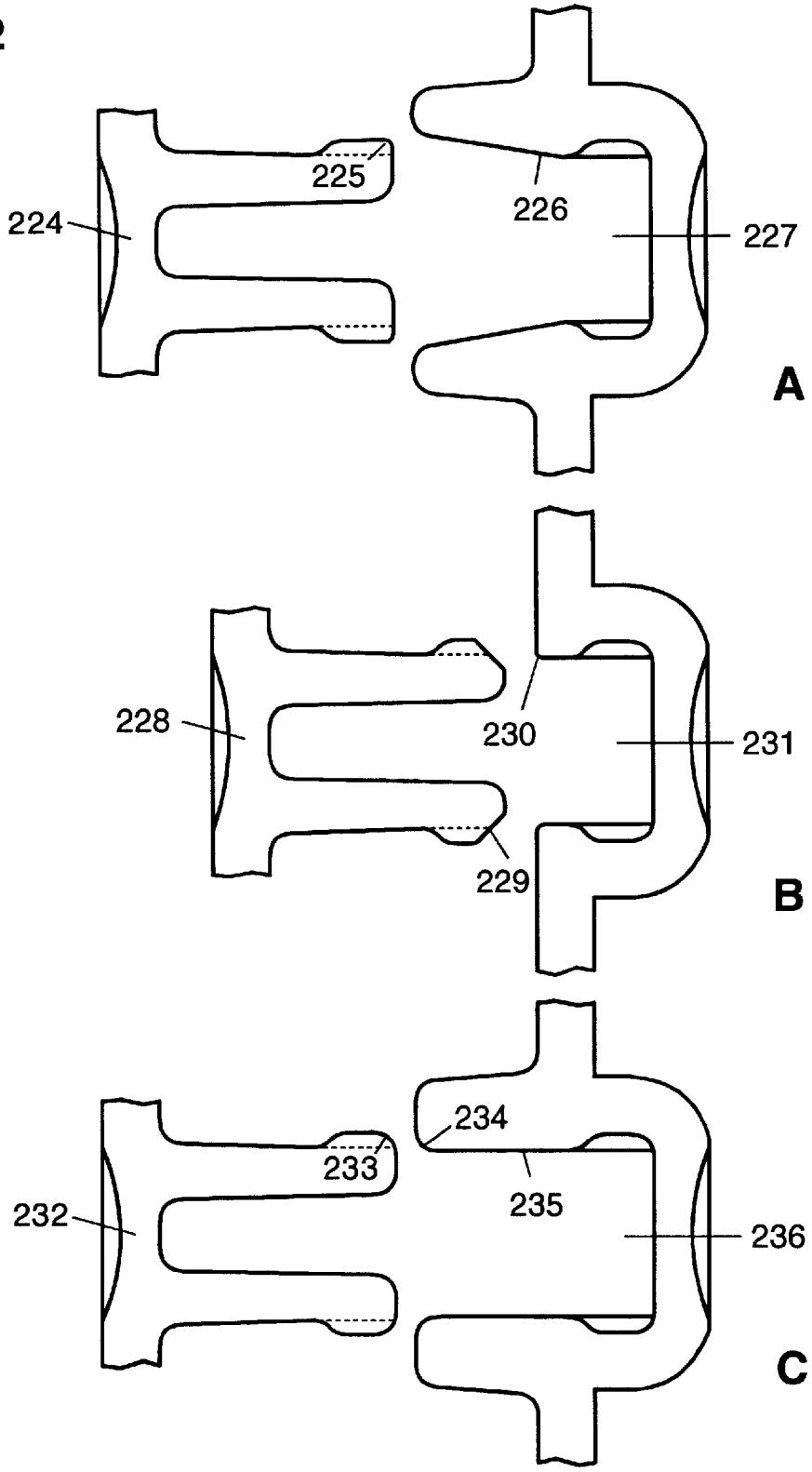
FIG. 12 shows plan views of three different embodiments of the connection element with FIG. 12A being closest to the preferred embodiment.

Though many different embodiments of the invention have been shown so far, there are still many possible designs that have not been shown. Some of these different embodiments will be shown with the aid of generic diagrams. When two snap-fit connection elements are engaged in the longitudinal direction Z, the male ribs must bend inwards towards each other before expanding outward again into the female groove. Some sort of angled surfaces must be used to compress the ribs together. FIG. 12 shows three different embodiments of the invention that can be used to accomplish this. In each case a male type one connection element is entering a female type two connection element. In FIG. 12A, a divergent recess 227 has a pair of divergent opposed walls 226 angled so that the female entrance is wider. This feature alone can be used to gradually compress even a pair of square ribs 224 with a square rib 225 when entering the divergent recess 227. A second method to gradually compress the ribs together is to use a square recess 231 with a square recess edge 230 along with a pair of angled ribs 228 which uses a tapered rib 229 as shown in FIG. 12B. The disadvantage of the latter method is that the length of the angled ribs 228 must usually be increased in the longitudinal direction Z due to the extra length of the tapered rib 229. A third method to gradually compress the ribs together is to use a parallel recess 236 and a pair of parallel opposed walls 235 and a pair of radiused ribs 232 having a radiused rib 233 as shown in FIG. 12C. The resulting friction is generally higher than using flatter angular surfaces however. A combination of the different methods just described could be used. For example the divergent recess 227 could be used with the radiused rib 233, as well as using a recess radius 234. The paired-snap construction element 100 uses this method, which result in a smoothly operating connection within tight space constraints.

The ribs 126 of the paired-snap construction element 100 are preloaded such that when they are engaged within the groove 154, they exert a force acting outward against the angled groove ramps 157 shown in FIG. 7. The greater this preload force is, the less the connection will start opening up gradually when increased forces attempt to separate the connection elements. With metal materials, this preload force could be very high, but plastic materials often have poorer creep characteristics. A high degree of preload makes it hard to slide the paired-snap construction elements 100 together with a vertical engagement 240 or even to locate the connection elements by feel. This is because the ribs 126 need to be spread apart further than the groove 154 before the start of the engagement. It is now a steeper part of the top radius 122 or the bottom radius 123 around the groove 154 entrance that helps to guide the ribs 126 in. Preload is not as much of a problem with a longitudinal engagement 237 as the female recess 152 can be quite divergent. A small amount of preload, roughly 25% of the maximum flexing force experienced during engagement, works best for toys. This is good because polypropylene generally has poorer creep characteristics than materials such as Acetal, which are often specified for such connection elements when a high amount of preload is used. For connection elements where plastics such as Acetal or metals can be used, the connection elements could be designed to have a much higher level of preload.

Figures 8, 9:
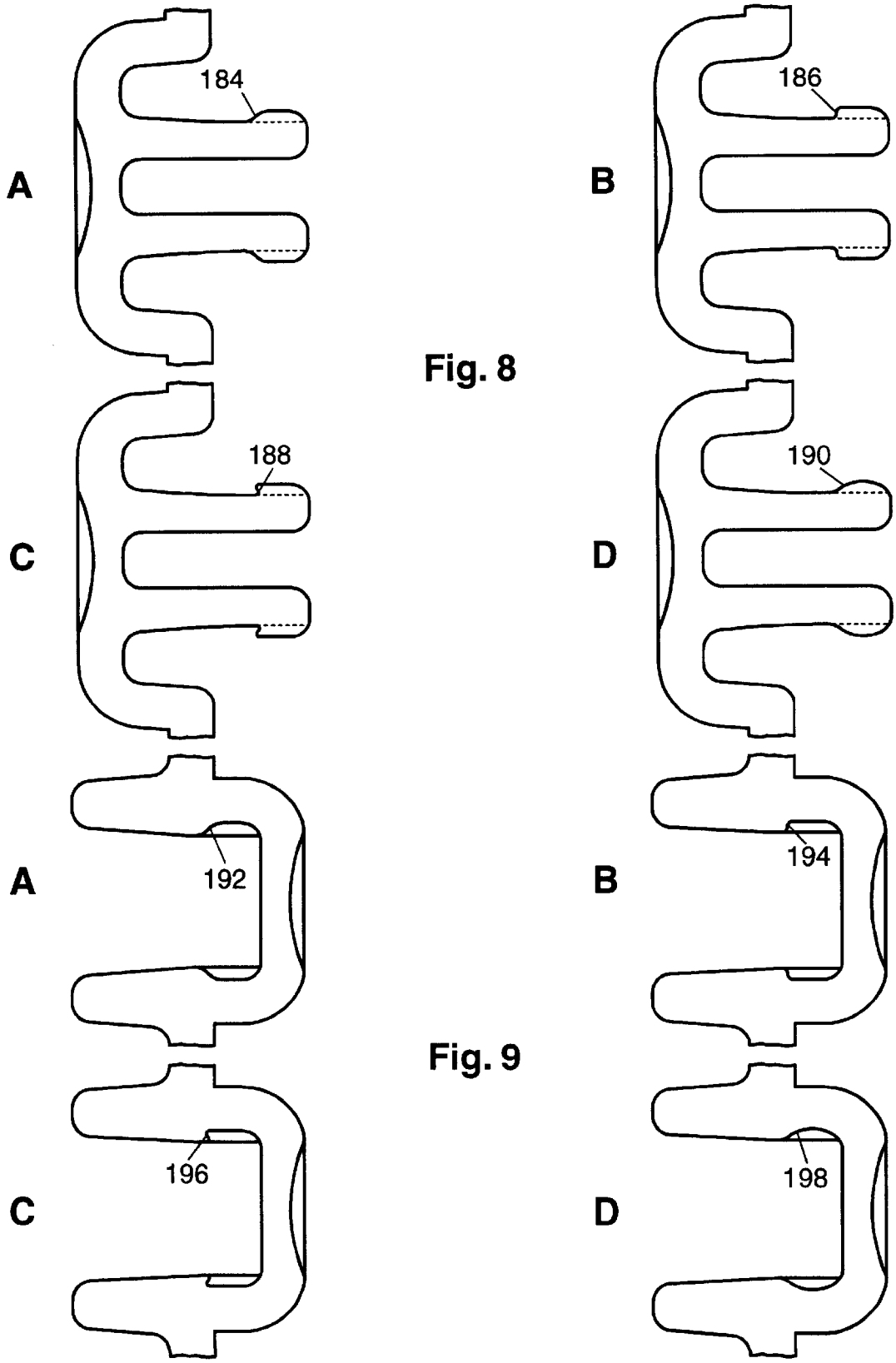
FIG. 8 is a large scale detailed plan view of four different embodiments of the male type one connection element with FIG. 8A being similar to the preferred embodiment.
FIG. 9 is a large scale detailed plan view of four different embodiments of the female type two connection element with FIG. 9A being similar to the preferred embodiment.

Different embodiments of the invention can use various angles of the ridge ramp and groove ramp. FIG. 8 shows top views of the male type one connection element with various angles of the ridge ramp and FIG. 9 shows top views of the female type two connection element with various angles of the groove ramp. A 45 degree ridge ramp angle 184 along with a 45 degree groove ramp angle 192 is ideal for many applications. These are the angles that are also used in the paired-snap construction element 100. Calculations show that with lubricated polypropylene and the 25% preload mentioned earlier, this angle resulted in a good compromise between easy separation of two construction elements, while at the same time holding the construction elements together with sufficient force. Somewhere around 60% of the maximum breakout force is required to begin to move the connection apart. For other purposes however, other angles can be used but some of the features mentioned for the paired-snap construction element 100 of FIG. 1 might be lost. For example with a 90 degree ridge ramp angle 186 along with a 90 degree groove ramp angle 194, it would be almost impossible to separate the connection in the longitudinal direction Z. A bulbous ridge ramp 190 combined with a bulbous groove ramp 198 results in the angle of contact changing more quickly on separation than the 45 degree ridge ramp angle 184 and manufacturing tolerances result in varying connecter characteristics. Of course the angles of the ridge ramp and groove ramp can be different, but to prevent scuffing and roughening of the contact surfaces, ideally they should be the same.

Figure 10:
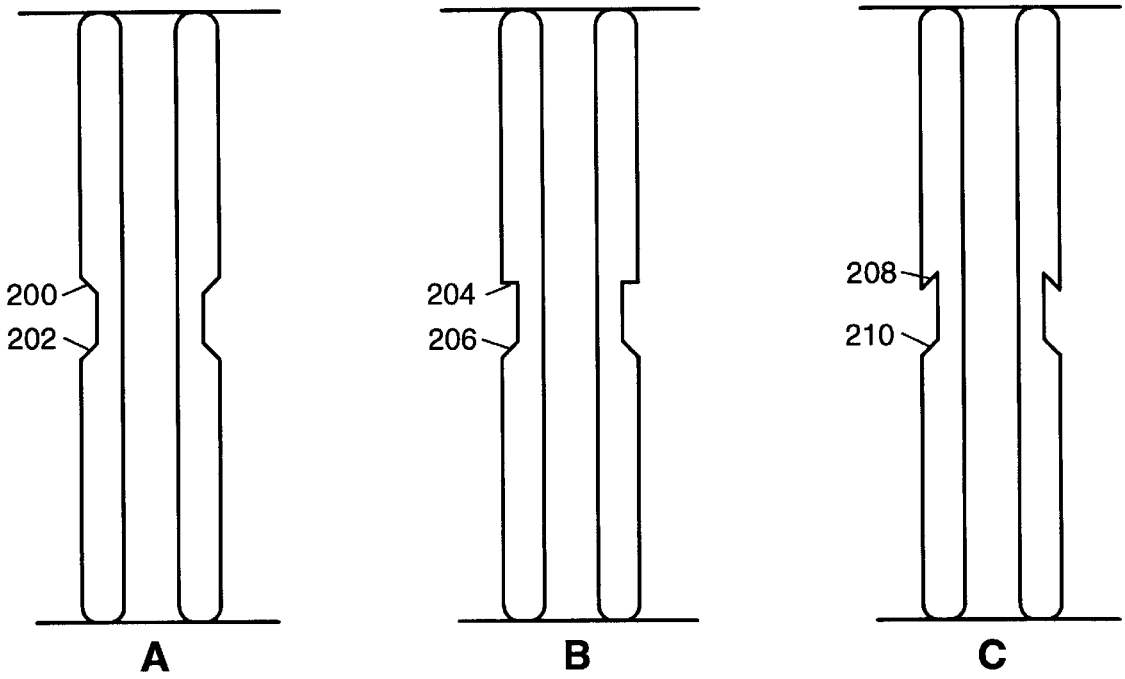
FIG. 10 is a large scale longitudinal view of three different embodiments showing the type one indentations with FIG. 10A being similar to the preferred embodiment.
Figure 11:
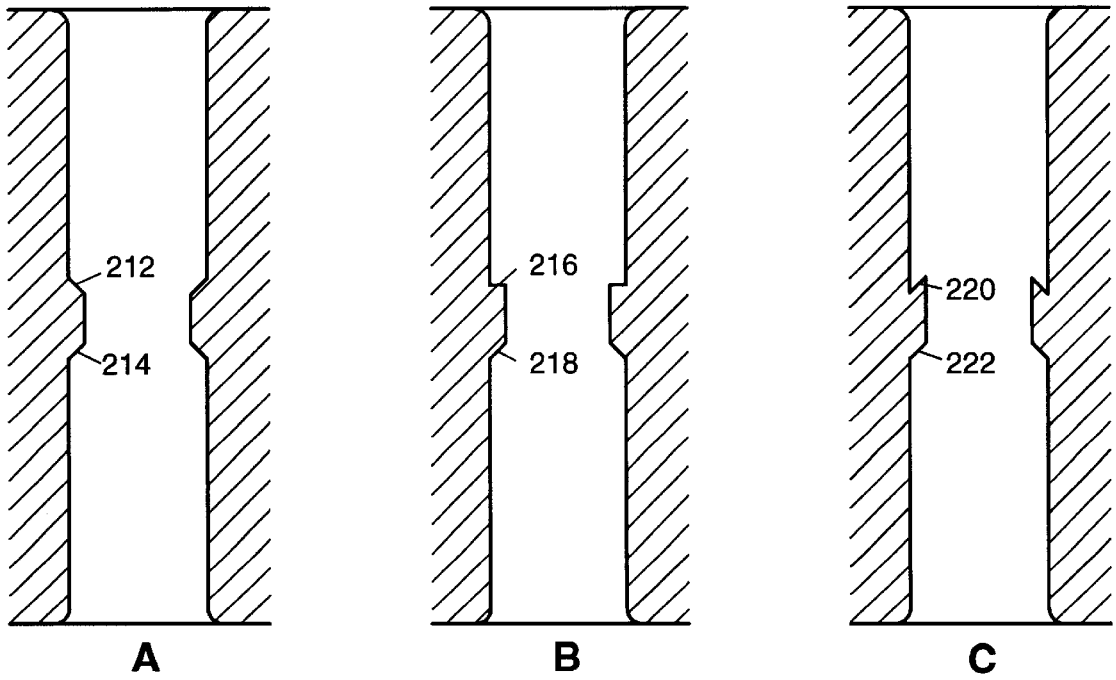
FIG. 11 is a large scale longitudinal section view through the plane of the projections of three different embodiments showing the type two projections with FIG. 11A being similar to the preferred embodiment.

Different embodiments of the invention can also use various angles of the indentations and projections. FIG. 10 shows longitudinal views of various angles of the indentation ramps and FIG. 11 shows longitudinal section views of various angles of the projection ramps. The indentations and projections keep the ribs from sliding along the grooves in the vertical direction Y. FIGS. 10A and 11A show a 45 degree indentation upper ramp 200 and a 45 degree indentation lower ramp 202 as well as a 45 degree projection upper ramp 212 and a 45 degree projection lower ramp 214. For toys, these angles result in a good compromise between being able to slide the connection apart in both vertical directions Y with a reasonable force, as well as holding the connection in place. These are the angles that are also used in the paired-snap construction element 100. To be able to apply a greater force downward along the groove before the connection opens but still retain most desirable features, a 90 degree indentation upper ramp 204 and 45 degree indentation lower ramp 206 along with a 90 degree projection upper ramp 216 and a 45 degree projection lower ramp 218 can be used as shown in FIG. 10B and 11B. It is also possible to make a 135 degree indentation upper ramp 208 and a 45 degree indentation lower ramp 210 along with a 135 degree projection upper ramp 220 and a 45 degree projection lower ramp 222 as shown in FIG. 10C and 11C. The indentation upper ramp now acts like a hook. A 45 degree indentation lower ramp 210 allows the part to still be made in a simple mold and allows the construction elements to still be taken apart by sliding in the vertical direction Y. One disadvantage of this last variation with 135 degree indentation upper ramp 208 is that extra clearances are necessary in the indentations making the connection sloppy in one vertical direction Y.

Of course other ridge, groove, indentation, and projection ramp angles than suggested here could be used as well. Not all combination of ramp angles would be easy to mold. Other combinations are not generally practical or would even work. For example a combination of a 135 degree ridge ramp angle 188 shown in FIG. 8C along with a 135 degree groove ramp angle 196 shown in FIG. 9C and any combinations of indentation and projections shown in FIGS. 10 and 11 would not work because the connection elements could not be pushed together with the longitudinal engagement 237 or the vertical engagement 240. The 135 degree ridge ramp angle 188 shown in FIG. 8C used with the 90 degree groove ramp angle 194 shown in FIG. 9B would be a way of making a strong connection that still would work.

Even while generally conforming to the basic features of the construction elements described so far, many more alternate embodiments of the invention are possible. There could be a variety of different top and bottom surface connections other than studs. One alternate stud connection would be a snap-fit system using a slight ridge in the stud and a slight undercut groove in the stud contact area. As well, the stud can have a groove where it meets the top surface of the construction element, and the stud contact can have a projection at the bottom surface. These methods have already been described in the prior art. Such connection methods however make it very difficult to remove large assemblies of construction elements that have been engaged together with both stud and snap-fit connections. It is contemplated that the top and bottom connection elements may be a variety of shapes and sizes. For example, in addition to the shape of round studs as illustrated in FIG. 1, the connections elements could take the shape of square studs, tabs, a single raised center area, etc. Preferably the connection element on the top surface of the construction element would be shaped and sized so as to mate with complimentary connection elements on the lower surface of an adjacent construction element. It is also possible that some construction elements will have no vertical connection elements or will have either top or bottom vertical connection elements. A construction element without top and bottom connection elements could be used for the floor of a building, for example.

The paired-snap construction element 100 shows the recess 152, groove 154, and anti-twist bars 162, as well as the ribs 126, ridges 128, and depressions 142 extending the full height of the construction element. This results in the strongest connection along with a construction element that is easy to use. Realistically, only the groove 154 and the depression 142 must travel the full height of the construction element in order that a snap-fit connection can be made with either a longitudinal engagement 237 or a vertical engagement 240 as illustrated in FIGS. 13 and 18. The ribs 126 and anti-twist bars 162 of the invention may be any length to provide a sufficiently rigid connection.

The paired-snap construction element 100 uses connection elements that can be engaged or separated in many different ways. This is ideal. For certain other situations however, it may be desirable to use less versatile connection elements due to space constraints for example. A snap-fit connection element could be made that had no means for engaging or separating with a longitudinal engagement 237, rather it could only be engaged or separated with a vertical engagement 240. Such a connection element could even be limited to engagement in one vertical direction Y due to the angles of the indentations and projections. Provided that such connection elements contain the right combination of grooves, projections, ridges, and indentations that are claimed, they are still an embodiment of the invention. Such embodiments would be a good substitute for certain dovetail connections.

FIGS. 70A and 70B show two quite different generic connection element embodiments of the invention. So far, all the embodiments of the connection element have conformed to FIG. 70A. This drawing shows a generic male type one connection element 450, with a pair of flexible ribs 458, with a pair of outward facing ridges 462, containing an indentation 464, to be engaged with a generic female type two connection element 452, containing a recess 468, and a pair of opposed walls 470, with a pair of inward facing grooves 472, containing projections 474, and a generic connection radius of 466. Because this male connection element 450 has a rib cavity 460, it is easy to mold, as a single core can be pulled out from between the rib cavity 460, allowing the ribs 458 to flex inward when being ejected from the mold. The opposed walls 470 being rigid, allows them to be molded into block type construction elements.

Another less practical but still valid embodiment of the invention is shown in FIG. 70B. This drawing shows a generic male type two connection element 454, with a pair of rib(s) 476, with a rib cavity 490, and a pair of inward facing grooves 478, with a projection 480, to be engaged with a generic female type one connection element 456, containing a recess 482, and a pair of flexible opposed walls 484, with an inward facing ridge 486, and an indentation 488. The rib(s) 476 could also be made into one rib. This design is not as easy to mold because it would require two mold parts to be pulled out from each side of the generic female type one connection element 456 to allow the opposed walls 484 to flex outward when being ejected from the mold. This design is not as practical to integrate into block type construction elements that have half-way sunken connections because, after engagement two spaces would be left on each side of the opposed walls 484 instead of one for FIG. 70A. This doesn't look as good and results in a total connection that is slightly wider in the horizontal direction X.

FIG. 70 shows the generic male type one connection element 450 to have a parallel rib cavity 460, but ribs that have an angled rib cavity 460 or otherwise angled ribs 458 also conform to the invention. Ribs 458 pointing together or apart can work provided the contacting angles are appropriate, but for most situations nearly parallel ribs have the most advantages. The parallel rib cavity 460 is often chosen for looks and so a rectangular wedge spacer construction element 360 can be inserted between the ribs 458.

Other connection elements very similar to those described in FIGS. 70A and 70B can be imagined but are not being claimed as an embodiment of the invention because they would not be as practical. Take for example the embodiment of FIG. 70A which was rather made with rigid ribs and flexible opposed walls. Or make the embodiment of FIG. 70B with flexible ribs and rigid opposed walls. In both cases the projections in the groove would severely hamper the flexibility of the ribs or opposed walls. As well, in both cases, the indentations on the more rigid ribs or opposed walls would make such a design difficult to mold.

In reality, connection elements are not completely flexible or totally rigid. Type one connection elements are the more flexible and type two are the more rigid in the invention. In the embodiment of FIG. 70A, the ribs 458 should be substantially more flexible than the opposed walls 470 and in the embodiment of FIG. 70B, the opposed walls 484 should be substantially more flexible than the rib(s) 476.

While the above descriptions contain many specifics, these should not be construed as limitations on the scope of the invention, but as examples of the presently preferred and alternate embodiments thereof. Many other ramifications and variations are possible within the teachings of the invention, as described above. Thus the greater scope of the invention should be determined by the appended claims and their legal equivalents, and not by the examples given.

We claim:

1. A snap-fit type construction system comprising of:

(a) various possible sets of construction elements, (b) said sets of construction elements having a male type one connection element and a female type two connection element, (c) said type one connection elements having a ridge and an indentation and type two connection elements having a groove and a projection, (d) said male type one connection elements having a pair of spaced apart ribs extending outward in a longitudinal direction from a side surface of said construction elements, a rib cavity being defined between them, with at least one of those faces of said ribs that face furthest away from said rib cavity being provided with said ridge projecting in a horizontal direction outward from said rib, running in a vertical direction up a considerable distance of the height of the bendable ends of said rib, with said ridges being provided with said indentation falling between the ends of the height of said ridges, (e) said female type two connection elements having a pair of opposed walls extending inwards in said longitudinal direction from said side of said construction elements, a recess being defined between said opposed walls and an end wall, with said recess having at free edges, an open face facing in said longitudinal direction, and two opposed open faces each facing in said vertical directions, with at least one of the sides of said opposed walls that face towards said recess being provided with said groove running in said vertical direction up along the entire height of said recess from a bottom surface to a top surface, with said groove being provided with said projection falling between the ends of the height of said grooves, (f) said ribs being resiliently bendable and substantially more bendable than said opposed walls, (g) said male type one connection element, including said ribs, said ridges, and said indentations, being of such a shape that by snap-effect are able to be received and releasably secured in said recess between said opposed walls by locating in said grooves and said projections of said female type two connection element, (h) whereby said male type one connection element and said female type two connection element may be used to connect different sizes and shapes of said construction elements together in a variety of orientations and for a variety of purposes.

2. The snap-fit construction system according to claim 1, further including a depression located against each of the outermost surfaces of said ribs, running in said vertical direction up along the entire height of the pair of said ribs, of a shape that allows said male type one connection element to be depressed roughly half-ways below said side surface of said construction element.

3. The snap-fit construction system according to claim 2, further including a pair of anti-twist bars which project outward in said longitudinal direction beyond said side surface of said female recess, the shape of said anti-twist bars being such that they substantially fill up said depressions when said male and female connection elements are fully engaged.

4. The snap-fit construction system according to claim 3, wherein said anti-twist bars and said depressions have angled surfaces such that said connection elements fit looser in said horizontal direction at the start of the engagement and tighter when fully engaged.

5. The snap-fit construction system according to claim 3, wherein a certain dimensioning of said ribs and said anti-twist bars allows them to interfit with each other when misengaged without causing undo stress or damage to said male and female connection elements.

6. The snap-fit construction system according to claim 1, wherein said male and female connection elements have a top radius and a bottom radius of a substantial amount such that said male connection elements can be engaged easily with said female connection elements in both of said vertical directions.

7. The snap-fit construction system according to claim 1, wherein said ribs contain a ridge outer radius of a substantial amount or a tapered rib with substantial taper such that said male connection elements can be engaged easily with said female connection elements in said longitudinal direction.

8. The snap-fit construction system according to claim 1, wherein said female connection element has said recess that is divergent in said longitudinal direction away from said endwall and the open end of said recess has a recess radius, both features being of such a dimension that would allow said ribs to gradually bend together during engagement in said longitudinal direction without a substantial force being required.

9. The snap-fit construction system according to claim 1, wherein one said male connection element and one said female connection element are grouped in said horizontal direction to each other as a pair, on said side surfaces of said construction elements that contain said connection elements.

10. The snap-fit construction system according to claim 1, further including said constructional elements being made with a hollow and generally parallelepiped construction.

11. The snap-fit construction system according to claim 1, further including a plurality of stud walls on said top surface of said construction elements and further including a plurality of stud contacts in the area of said bottom surface of said constructional elements which are of such a dimension that said top and bottom surfaces of said construction elements can be engaged together as a result of a frictional fit between said stud walls and said stud contacts.

12. The snap-fit construction system according to claim 1, wherein a ramp angle of said ridges, said grooves, said indentations, and said projections is approximately 45 degrees.

13. The snap-fit construction system according to claim 1, further including a lubricant of sufficient quantity and useful type being applied to said connection elements that will substantially reduce the friction and forces required to engage and separate connection elements.

14. The snap-fit construction system according to claim 1, further including a wedge spacer construction element of a size and type of material, which, when it is inserted into said rib cavity of said male and female connection elements that are engaged, said wedge spacer will increase the force necessary to separate said male and female connection elements, said wedge spacer construction element being of various heights including heights that can be used for connecting other said construction elements together in said vertical direction.

15. The snap-fit construction system according to claim 1, further including a vertical hole construction element containing a vertical hole through said vertical hole construction element allowing a complimentary connection device such as a snap-pin or a threaded rod to be used to engage two or more said vertical hole construction elements together.

16. A snap-fit type construction system according to claim 1, (a) further including a depression located against each of the outermost surfaces of said ribs, running in said vertical direction up along the entire height of the pair of said ribs, of a shape that allows said male type one connection element to be depressed roughly half-ways below said side surface of said construction element, (b) further including a pair of anti-twist bars which project outward in said longitudinal direction beyond said side surface of said female recess, the shape of said anti-twist bars being such that they substantially fill up said depressions when said male and female connection elements are fully engaged, (c) wherein a certain dimensioning of said ribs and said anti-twist bars allows them to interfit with each other when misengaged without causing undo stress or damage to said male and female connection elements, (d) wherein said male and female connection elements have a top radius and a bottom radius of a substantial amount such that said male connection elements can be engaged easily with said female connection elements in both of said vertical directions, (e) wherein said ribs contain a ridge outer radius of a substantial amount or a tapered rib with substantial taper such that said male connection elements can be engaged easily with said female connection elements in said longitudinal direction, (f) wherein said female connection element has a recess that is divergent in said longitudinal direction away from said endwall and the open end of said recess has a recess radius, both features being of such a dimension that would allow said ribs to gradually bend together during engagement in said longitudinal direction without a substantial force being required, (g) wherein one said male connection element and one said female connection element are grouped in said horizontal direction to each other as a pair, on said side surfaces of said construction elements that contain said connection elements, (h) further including said constructional elements being made with a hollow and generally parallelepiped construction, (i) wherein said anti-twist bars and said depressions have angled surfaces such that said connection elements fit looser in said horizontal direction at the start of the engagement and tighter when fully engaged.

17. The snap-fit construction system according to claim 16, further including a plurality of stud walls on said top surface of said construction elements and further including a plurality of stud contacts in the area of said bottom surface of said constructional elements which are of such a dimension that said top and bottom surfaces of said construction elements can be engaged together as a result of an interference fit between said stud walls and said stud contacts.

18. A snap-fit type construction system comprising of:

(a) various possible sets of construction elements, (b) said sets of construction elements having a male type one connection element for connecting to a female type two connection element as well as a male type two connection element for connecting to a female type one connection element, (c) wherein said type one connection elements are the more resiliently bendable and said type two connection element are the less resiliently bendable, (d) said male connection elements having a rib and said female connection elements having a recess, (e) said type one connection elements having a ridge and an indentation and said type two connection elements having a groove and a projection, (f) said male type one connection elements having pairs of said spaced apart ribs extending in a longitudinal direction from a side surface of said construction elements, a rib cavity being defined between them, with at least one of those faces of said ribs that face furthest away from said rib cavity being provided with said ridge projecting in a horizontal direction outward from said rib, running in a vertical direction up a considerable distance of the height of the bendable ends of said rib, with said ridges being provided with said indentation falling between the ends of the height of said ridges, (g) said female type two connection elements having a pair of opposed walls extending in said longitudinal direction from said side surface of said construction elements, said recess being between said opposed walls and an end wall, with said recess having at free edges, an open face facing in said longitudinal direction, and two opposed open faces each facing in said vertical directions, with at least one of the sides of said opposed walls that face towards said recess being provided with said groove running in said vertical direction up along the entire height of said recess from a bottom surface to a top surface, with said groove being provided with said projection falling between the ends of the height of said grooves, (h) said male type two connection elements having pairs of said spaced apart ribs extending in said longitudinal direction from said side surface of said construction elements, said rib cavity being defined between them which can be filled in to form a solid single rib if desired, with at least one of the outermost faces of said ribs being provided with said groove running in said vertical direction up along the entire height of said rib from said bottom surface to said top surface, with said groove being provided with said projection falling between the ends of the height of said grooves, (i) said female type one connection elements having said opposed walls extending in said longitudinal direction from said side of said construction elements, said recess being between said opposed walls and said end wall, with said recess having at free edges, an open face facing in said longitudinal direction, and two opposed open faces each facing in said vertical directions, with at least one of said sides of said opposed walls that face towards said recess being provided with said ridge projecting in said horizontal direction outward from said opposed walls, running in said vertical direction up a considerable distance of the height of the bendable ends of said opposed walls, with said ridges being provided with said indentation falling between the ends of the height of said ridges, (j) said male connection element being of such a shape that by snap-effect is able to be received and releasably secured in said female connection element, (k) whereby said male connection element and said female connection element may be used to connect different sizes and shapes of said construction elements together in a variety of orientations and for a variety of purposes.

19. The snap-fit construction system according to claim 18, further including said sets of construction elements containing construction element shapes and connection element features being selected from the group consisting of said construction element shapes including squares, rectangles, triangles, polygons, beams, radial-hubs, struts, rods, wires, panels, adaptors, rotators, letters, numbers, pictures, pry tools, and said connection element features including sunken connection elements, depressions, anti-twist bars, tapered anti-twist bars, divergent recesses, top and bottom radiuses, parallelepiped construction, stud connecters, wedge spacers, vertical holes, snap-pins, various ramp angles, and lubricants.

20. A snap-fit type construction system comprising:

(a) various possible sets of construction elements, (b) said sets of construction elements having a male type one connection element for connecting to a female type two connection element as well as a male type two connection element for connecting to a female type one connection element, (c) wherein said type one connection elements are the more resiliently bendable and said type two connection elements are less resiliently bendable, (d) said male connection elements having a rib and said female connection elements having a recess, (e) said type one connection elements having a ridge and an indentation and said type two connection elements having a groove and a projection, (f) said male type one connection elements having a pair of rows of spaced apart ribs extending in a longitudinal direction from said side surface of said construction elements, a rib cavity being defined between them, with at least one of those faces of said ribs that face furthest away from said rib cavity being provided with said ridge projecting outward in a horizontal direction from said rib, running in said vertical direction up a considerable distance of the height of the bendable ends of said rib, with said ridges being provided with said indentation falling between the ends of the height of said ridges, (g) said female type two connection elements having a pair of rows of opposed walls extending in said longitudinal direction from said side surface of said construction elements, said recess being between said opposed walls and an end wall, with said recess having at free edges, an open face facing in said longitudinal direction, and two opposed open faces each facing in said vertical directions, with at least one of the sides of said opposed walls that face towards said recess being provided with said groove running in said vertical direction up along the entire height of said opposed wall, with said groove being provided with said projection falling between the ends of the height of said grooves, (h) said male type two connection elements having a pair of rows of said spaced apart ribs extending in said longitudinal direction from said side surface of said construction elements, said rib cavity being defined between them which can be filled in to form a solid single rib if desired, with at least one of the outermost faces of said ribs being provided with said groove running in said vertical direction up along the entire height of said rib, with said groove being provided with said projection falling between the ends of the height of said grooves, (i) said female type one connection elements having rows of said opposed walls extending in said longitudinal direction from said side of said construction elements, said recess being between said opposed walls and said end wall, with said recess having at free edges, an open face facing in said longitudinal direction, and two opposed open faces each facing in said vertical directions, with at least one of said sides of said opposed walls that face towards said recess being provided with said ridge projecting in said horizontal direction outward from said opposed walls, running in a vertical direction up a considerable distance of the height of the bendable ends of said opposed walls, with said ridges being provided with said indentation falling between the ends of the height of said ridges (j) said pair of rows of spaced apart ribs and said rows of opposed walls includes those that are staggered in said vertical direction and contain a plurality of gaps between other said ribs or said opposed walls above or below them whereby a panel construction element can be molded in said horizontal direction as opposed to said vertical direction, in a way that said panel construction elements that are tall and thin can be easily molded, (k) said indentations of said ridges being any form of reduction in said ridge projecting outward in said horizontal direction between the ends of the height of said ridges, including a slot cutting through a part or whole of said ribs, (l) said male connection element being of such a shape that by snap-effect is able to be received and releasably secured in said female connection element, (m) whereby said male connection element and said female connection element may be used to connect different sizes and shapes of said construction elements together in a variety of orientations and for a variety of purposes.

* * * * *